US007219819B2

(12) United States Patent
Halfacre et al.

(10) Patent No.: US 7,219,819 B2
(45) Date of Patent: May 22, 2007

(54) SELF-VENTING VALVE

(75) Inventors: J Wayne Halfacre, New Fairfield, CT (US); John S Gruver, New Canaan, CT (US); Christian Randhahn, Bethel, CT (US); Charles A Curtiss, Norwalk, CT (US); Stuart Leslie, Larchmont, NY (US); Christopher J Matice, Bellbrook, OH (US); Stephen P DeHoff, Cincinnati, OH (US)

(73) Assignee: Nestle Waters North America, Inc., Greenwich, CT (US)

( * ) Notice: Subject to any disclaimer, the term of this patent is extended or adjusted under 35 U.S.C. 154(b) by 346 days.

(21) Appl. No.: 10/692,995

(22) Filed: Oct. 24, 2003

(65) Prior Publication Data

US 2005/0087553 A1 Apr. 28, 2005

(51) Int. Cl.
*B67D 3/00* (2006.01)

(52) U.S. Cl. ..... 222/484; 222/488; 222/506

(58) Field of Classification Search ..... 222/516, 222/484, 505–506, 485, 488, 515, 536, 548; 137/588–589

See application file for complete search history.

(56) References Cited

U.S. PATENT DOCUMENTS

| | | | | | |
|---|---|---|---|---|---|
| 1,992,319 | A * | 2/1935 | Maggenti | 222/91 |
| 1,998,586 | A * | 4/1935 | Maggenti | 222/91 |
| 2,841,313 | A * | 7/1958 | Beall, Jr. | 222/479 |
| 3,595,445 | A * | 7/1971 | Buford et al. | 222/213 |
| 4,877,159 | A * | 10/1989 | Strand | 222/484 |
| 4,946,079 | A * | 8/1990 | Campbell | 222/484 |
| 4,997,108 | A * | 3/1991 | Hata | 222/105 |
| 5,111,970 | A * | 5/1992 | Rutter et al. | 222/83 |
| 5,303,850 | A * | 4/1994 | Connan | 222/153.07 |
| 5,400,840 | A * | 3/1995 | Flaherty | 141/384 |
| 6,446,845 | B1 * | 9/2002 | Steiger | 222/509 |
| 6,793,104 | B2 * | 9/2004 | Kao | 222/481.5 |

OTHER PUBLICATIONS

DS Smith (UK) Limited, World Wide Dispensers Brochure, 2001, available at <http://www.dssmith-plastics.com/downloads/English_WD.pdf> (last visited Oct. 23, 2003).

DS Smith (UK) Limited, World Wide Dispensers Press Taps Drawings, accessed at <http://www.wwdusa.com/7-pd.html> (as viewed on Sep. 9, 2002), currently available at <http://www.wwdusa.com/drawpress.htm> (last visited Oct. 23, 2003).

DS Smith (UK) Limited, World Wide Dispensers Press Taps Product Description, accessed at <http://www.wwdusa.com/7-press.html> (as viewed on Sep. 9, 2002), currently available at <http://www.wwdusa.com/tappress.htm> (last visited Oct. 23, 2003).

* cited by examiner

*Primary Examiner*—Frederick C. Nicolas
(74) *Attorney, Agent, or Firm*—Fish & Neave IP Group, Ropes & Gray LLP; Jeffrey C. Aldridge

(57) ABSTRACT

A valve assembly has a valve housing and a valve core body movable therewithin for providing a smooth and continuous outflow of liquid from a container, which may be unvented and rigid, through a liquid-out passageway, and provides an air-back passageway for drawing external air into the container. In a preferred embodiment, the core is rotatable within the housing by one-handed actuation. The air-back passageway is preferably a channel provided on the surface of the core body, and the liquid-out passageway is preferably provided between openings in the core body.

94 Claims, 24 Drawing Sheets

310

310

310

SELF-VENTING VALVE

BACKGROUND OF THE INVENTION

This invention relates to a self-venting valve for providing, and controlling the rate of, a smooth and continuous fluid flow.

It is known to provide molded plastic valves for dispensing liquid from containers, in particular disposable containers of the type popular for holding a liquid such as water, juice or detergent. One well known type of valve for this purpose is a so-called "rotary" valve. In this type of valve, a handle is rotatably actuated by a user to rotate a valve core within a valve housing that is attached to a container. Rotation of the core aligns an aperture in the core with an aperture in the housing to provide a passageway that allows liquid to flow from the container.

An alternative to the rotary valve is a so-called "push button" valve. This type has a resilient plastic valve diaphragm which, when pressed by a user, opens an aperture provided in the valve housing to allow liquid to flow from the container. The resilient plastic diaphragm, commonly referred to as a "push button", can be arranged so that it positively seals the aperture when manual pressure is removed, thus providing for a self-closing valve. Tap valves of this type require the user to provide manual pressure to the push button throughout the liquid dispensing process, which can be inconvenient when dispensing large quantities of a liquid, particularly when one of the user's hands is needed to hold a receptacle, such as a drinking glass, leaving only one hand to actuate the push button.

Effective metering of the flow rate is generally more difficult to achieve with push button valves than it is with rotary valves. In practice, push button valves provide substantially only "ON/OFF" operation.

Also, there are known slide valves that require a user to push or pull a part of the valve in a certain direction to actuate the valve, but actuation of such a valve may cause the container to unintentionally slide in that direction. If, as is commonly the case, that direction is toward the user, the container could be pulled off the surface it is resting on, unless one hand is used to restrain the container. However, the user's second hand normally would be occupied holding the drinking glass or other receptacle.

Regardless of the valve type used, when a liquid is dispensed through an aperture in a container and valve, ambient pressure above the liquid level in the container drops and creates a partial vacuum. This vacuum must be filled by a volume of fluid—generally air—equal to the volume of liquid that has been removed to equalize the pressure within the container. In early containers, the pressure was equalized by external air drawn into the container through the same valve aperture through which the liquid exited the container. However, in such an arrangement, the external air attempting to enter the container would disrupt the outflow of liquid attempting to exit the container, thereby causing discontinuous liquid flow (i.e., "glugging") and reducing the outflow rate.

It is known that continuous and smooth liquid flow can be achieved using containers that are capable of collapsing as liquid flows therefrom or using containers that are vented, because these types of containers are able to decrease the magnitude of the partial vacuum created above the liquid level inside the container without requiring air to flow into the container through the valve. However, a collapsible container, such as a balloon or bag, for example, may be easily damaged and may not be easily attached to a valve. A vented container may allow the contents to be spoiled by substantially continuous exposure to air and to be spilled from the vent. These problems can be addressed by providing a vent that is sealed until opened by the user (e.g., by puncturing), but once the vent is unsealed, spillage and spoilage become possible. A reclosable vent can be provided, but users are unlikely to bother reclosing the vent.

Accordingly, it would be advantageous to be able to provide a container with a valve that provides a smooth and continuous outflow of liquid therefrom by maintaining neutral atmospheric pressure within the container while dispensing the liquid, even when the container is unvented or substantially rigid, and that allows the liquid outflow rate to be varied.

SUMMARY OF THE INVENTION

It is an object of this invention to provide a container with a valve that provides a smooth and continuous outflow of liquid therefrom by maintaining neutral atmospheric pressure within the container while dispensing the liquid, even when the container is unvented or substantially rigid.

It is also an object of this invention to provide such a valve that allows the liquid outflow rate to be varied.

In accordance with the present invention, there is provided a container with a valve assembly for providing to a user continuous liquid flow. The container has an orifice in a side-wall, and the orifice has a valve attachment to which the valve assembly is attached in communication with the orifice. The valve assembly comprises a valve housing that includes a housing body portion. The housing body portion has an air-back aperture and a liquid-out aperture in a first side facing the orifice, a spout in a second side facing away from the orifice, and a substantially hollow interior between the first side and the second side. The valve housing also includes a housing attachment that extends from the air-back aperture and the liquid-out aperture on the first side and that attaches the housing body portion to the valve attachment. The valve assembly also comprises a valve core that includes a core body. The core body has a liquid-out passageway and an air-back passageway and moves within the hollow interior to register the liquid-out passageway with the liquid-out aperture and the spout to control liquid flow through the liquid-out passageway, and to register the air-back passageway with the air-back aperture and the spout to control fluid flow through the air-back passageway between the air-back aperture and the spout.

BRIEF DESCRIPTION OF THE DRAWINGS

The above and other advantages of the invention will be more apparent upon consideration of the following detailed description, taken in conjunction with the accompanying drawings, in which like reference characters refer to like parts throughout, and in which.

DETAILED DESCRIPTION OF THE INVENTION

Figure 1:
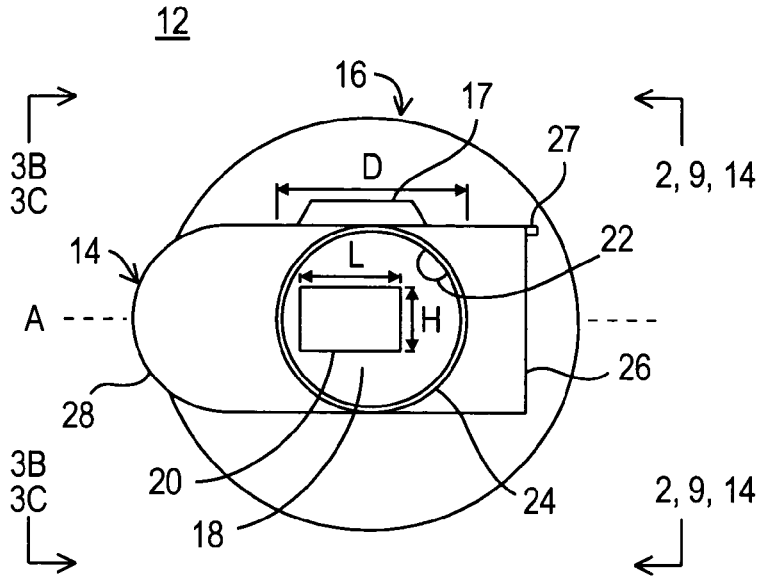
FIG. 1 is a front elevational view of a preferred embodiment of a valve housing according to the present invention.

The present invention provides dispensing of a smooth and continuous flow of liquid from a rigid or unvented container through a valve assembly having a housing attached to the container, and a core that is movable, and particularly rotatable, within the housing to provide both a liquid-out passageway and an at least partially separate air-return passageway between the container and the ambient atmosphere. Preferably, the core has a handle or actuator that is rotatable by one hand of a user. Also preferably, the housing and core cooperate to allow metering of the liquid outflow rate. The user, preferably, can let go of the actuator once the desired liquid outflow rate is achieved and the valve assembly will remain in that position to dispense liquid until closed by the user.

Because an air-back passageway is at least in part formed separately from the liquid-out passageway, air can flow into the container simultaneously with the dispensing of liquid therefrom. Thus, the pressure can continuously be equalized between the exterior of the container and the interior of the container above the liquid level, so that the liquid will flow smoothly and at a controllable rate dictated by the relative position of the housing and the core, without requiring venting or the provision of a collapsible container.

In accordance with the invention, the valve housing preferably has a hollow interior, an air-back aperture, a liquid-out aperture, a spout, and an attachment that may attach to a container. The valve core preferably has a handle or actuator attached thereto for moving the core relative to the housing to control both the size of the air-back passageway preferably provided between the air-back aperture and the spout, and the size of the liquid-out passageway preferably provided between the liquid-out aperture and the spout. The air-back aperture and the liquid-out aperture may be generally adjacent one another, but the air-back aperture should be at least partially above the liquid-out aperture, so that the liquid pressure at the container end of the air-back passageway is less than that at the container end of the liquid-out passageway. This pressure differential may be enhanced by extending an extension tube within the container upward from the air-back aperture into the container.

As stated above, the core is preferably rotated, but other types of movement can be used. For example, the core may translate or slide. Alternatively, a combination of movements can be used. For example, the core could primarily rotate, but there could be a translational component to the movement as well. As the core is moved, the degree of registration of each respective passageway with the spout and with its corresponding aperture preferably changes. Upon initial actuation of the actuator or handle to move the core, liquid will begin to flow from the full or previously unopened container, through both passageways, to the spout as the passageways begin to register with the apertures. As liquid flows out of the container, the ambient pressure above the liquid level inside the container will drop, thereby creating a partial vacuum.

As the ambient pressure above the liquid level inside the container drops below the external ambient pressure, the partial vacuum thereby created preferably draws air into the container through the air-back passageway, displacing the liquid already in that passageway. Air preferably will enter the air-back passageway, and not the liquid-out passageway, because of the aforementioned lower pressure at the container end of the air-back passageway. Also, this passageway is preferably made narrower than the liquid-out passageway so that the amount of liquid to be displaced by air in the air-back passageway is less than that in the liquid-out passageway. This also will favor establishment of the air-back flow in this passageway. The relative sizes of the passageways preferably depend upon various factors including the range of desired rate of liquid flow from the container, the viscosity of the liquid, and the relative heights of the air-back aperture and liquid-out aperture in the container, etc.

Once air begins to flow into the container, this effect preferably is self-sustaining throughout further actuation of the core in both the opening and closing directions of the valve, until the valve is completely closed, as long as a partial vacuum exists above the liquid level. Preferably, the seal between the valve assembly and the container and the seal between the valve housing and the valve core are sufficient to maintain a degree of partial vacuum inside the container when the valve is completely closed, so that the air-back effect is immediate upon reopening of the valve. If the vacuum is not maintained when the valve is closed, then the next time the valve is opened, operation will be similar to the initial time that the valve was opened.

In one embodiment, the liquid-out passageway is formed within a hollow interior of the core between two openings formed in the surface of the core, and the air-back passageway is formed about the core along a channel formed in the surface of the core. In a second embodiment, both the air-back passageway and the liquid-out passageway are formed about the core along respective channels formed into the surface of the core. In a third embodiment, both the air-back passageway and the liquid-out passageway are formed by respective passageways within the hollow interior of the core between respective pairs of openings formed in the surface of the core.

A tamper-evident seal preferably is provided. This seal preferably also acts as a dust cover to keep dust and debris out of the spout prior to initial use and between uses (if replaced by the user). Preferably, the seal also engages with the valve to prevent valve actuation when the seal is in place.

The invention will now be described with reference to FIGS. 1–78.

FIGS. 1–3C show a preferred embodiment of a valve housing 12 and FIGS. 4–8 show a preferred embodiment of a valve core 32 according to the present invention.

As seen in FIGS. 1–3A, valve housing 12 preferably includes a hollow substantially cylindrical body portion 14 attached to a container fitment portion 16, which preferably extends from periphery or surface section 18 of body portion 14 substantially perpendicularly to longitudinal axis A of body portion 14. Preferably, two apertures—a liquid-out aperture 20 and an air-back aperture 22—are formed through periphery 18 of body portion 14 to allow liquid and air to move between the hollow of body portion 14 and fitment portion 16, although any larger number of apertures may be provided.

In a preferred embodiment, liquid-out aperture 20 is substantially rectangular, having a height H and a length L, and air-back aperture 22 is substantially circular, having a diameter d. In addition, a distance h substantially separates the top of aperture 20 from the top of aperture 22, as shown, to provide a pressure difference between the container end of air-back aperture 22 and the container end of liquid-back aperture 20. Instead of or in addition to a distance h separating the tops of the apertures, extension tube 23 (see FIG. 3C) preferably is provided to lower the pressure at the container end of air-back aperture 22 even more as compared to that at the container end of liquid-out aperture 20, for reasons explained above. Opposite fitment portion 16, a spout portion 24 preferably extends from body portion 14 for dispensing liquid from body portion 14 to a user and for supplying external air to body portion 14. Preferably, spout 24 provides a substantially circular opening, having a diameter D. The shape and size of spout 24 may be chosen to substantially match the aperture of a variety of receptacles to be filled by the user.

Body portion 14 is shown extending along longitudinal axis A, from a preferably open end 26, past spout portion 24 and apertures 20 and 22, to a closed end 28, although end 28 may conceivably be open, as long as a liquid tight seal can be formed at that end between body portion 14 and valve core 32 in the assembled valve. In a more particularly preferred embodiment, open end 26 includes an actuation stop 27 for limiting the actuation range of a valve core (described below). Housing 12 may be formed from any suitable material such as high-density polyethylene, low-density polyethylene, polypropylene, linear low-density polyethylene, or other polymer.

Fitment portion 16 preferably includes screw threads 30 to allow attachment of housing 12 to a threaded collar around an orifice in a side-wall of a liquid container (not shown). It will be appreciated that housing 12 may be attached to a container in other ways, such as with a snap-fitted collar, or by gluing or ultrasonic welding, etc. It should be noted that this attachment may be made at any angle relative to the bottom of the container (i.e., relative to the liquid level inside the container).

Figure 3A:
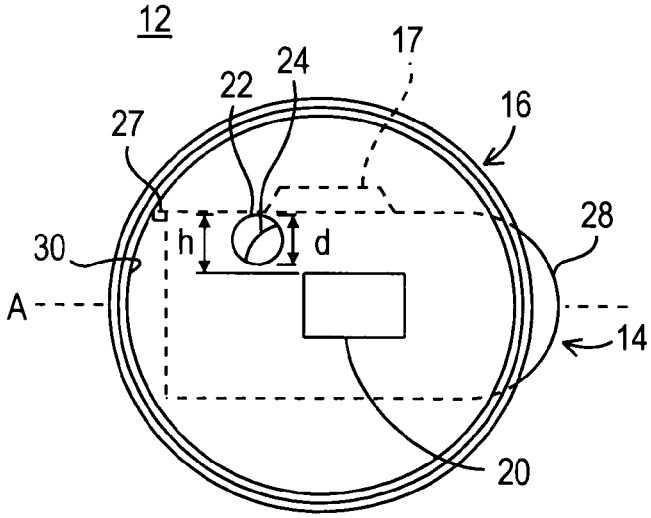
FIG. 3A is a rear elevational view of the valve housing of FIGS. 1 and 2, taken from line 3A—3A of FIG. 2, but with most of the fitment omitted.
Figure 3B:
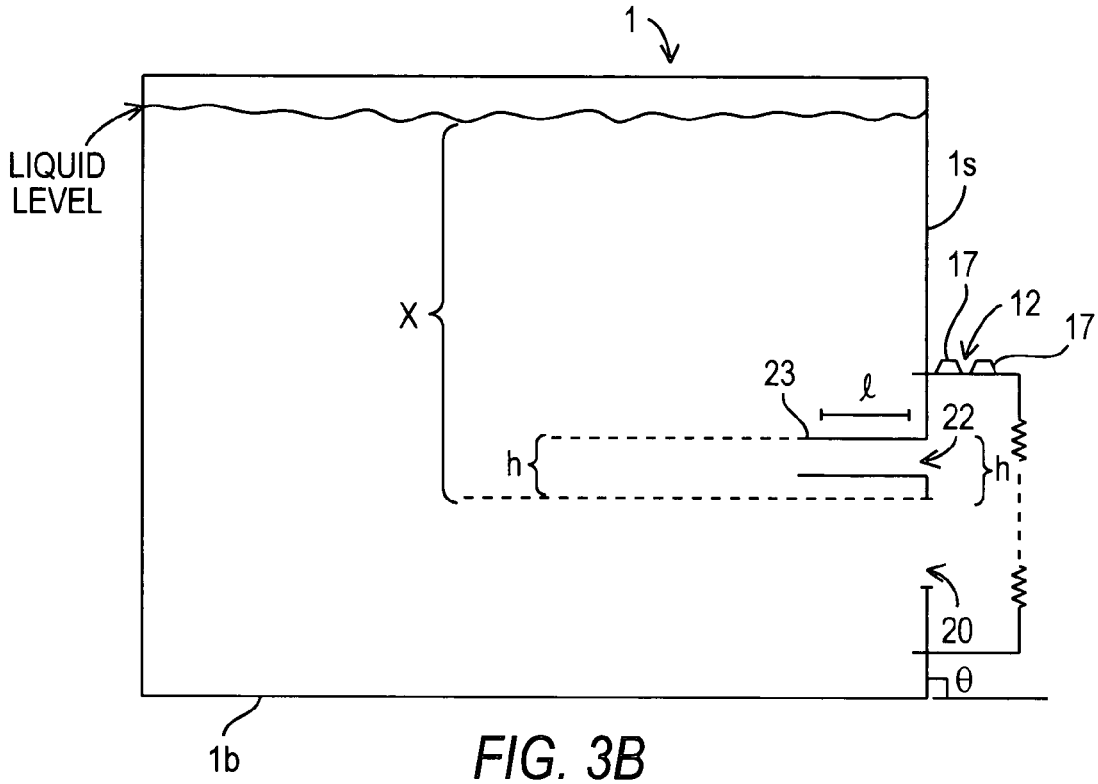
FIGS. 3B and 3C are vertical cross-sectional views of the valve housing of FIGS. 1–3A, taken from line 3B of FIG. 1, cooperating with a container.
Figure 3C:
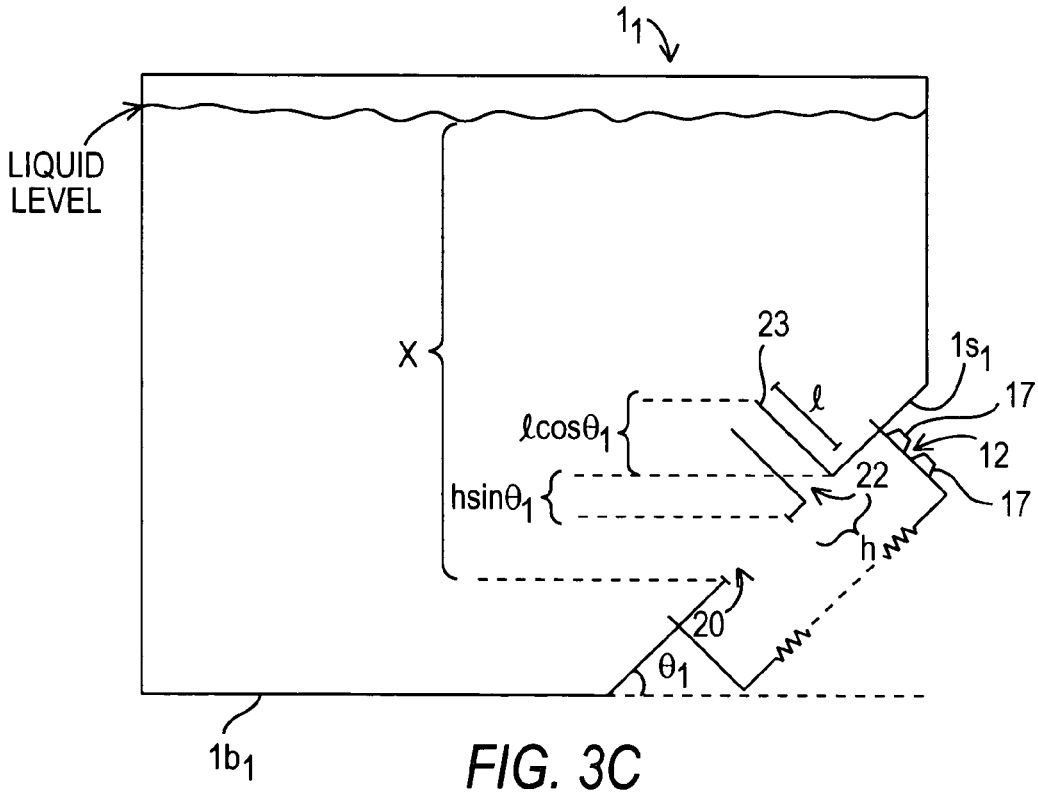
Figure 4:
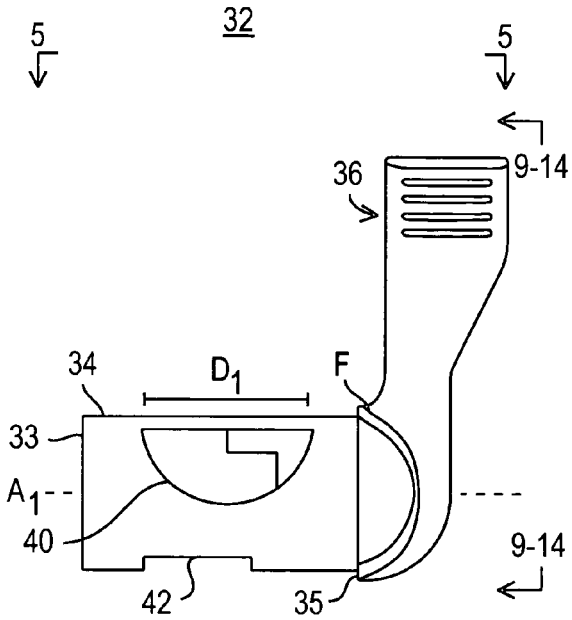
FIG. 4 is a side elevational view of a preferred embodiment of a valve core according to the present invention.
Figure 5:
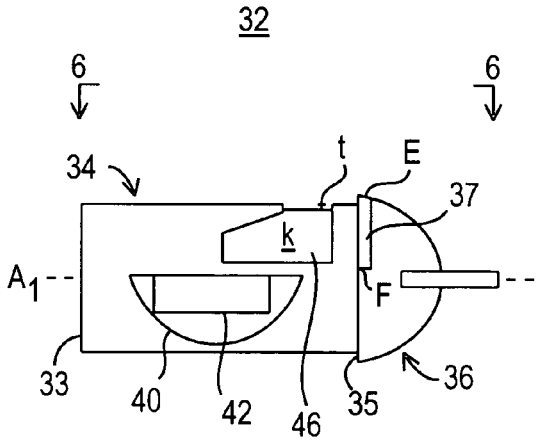
FIG. 5 is an elevational view of the valve core of FIG. 4, taken from line 5—5 of FIG. 4.
Figure 8:
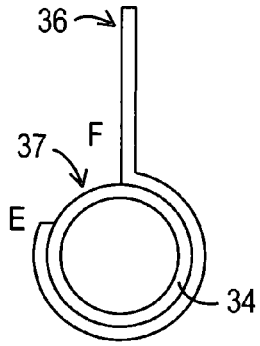
FIG. 8 is an end view of the valve core of FIGS. 4–7, taken from line 8—8 of FIG. 7.
Figure 6:
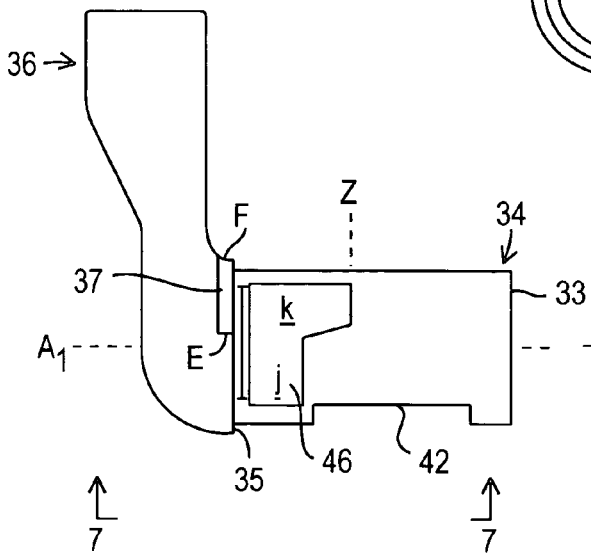
FIG. 6 is an elevational view of the valve core of FIGS. 4 and 5, taken from line 6—6 of FIG. 5.
Figure 7:
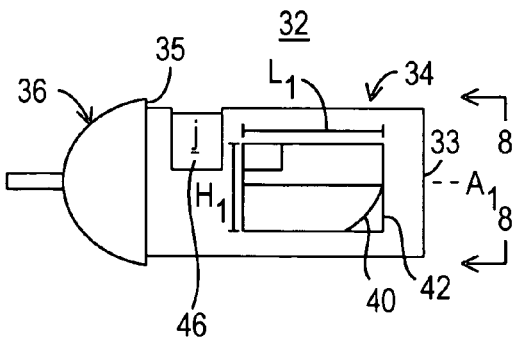
FIG. 7 is an elevational view of the valve core of FIGS. 4–6, taken from line 7—7 of FIG. 6.

Each of FIGS. 3B and 3C shows a portion of valve housing 12 attached to a side-wall of a container. So that the liquid pressure at the container end of the air-back passageway is less than the liquid pressure at the container end of the liquid-out passageway, for reasons stated above, the height of the liquid level above the container end of air-back aperture 22 preferably should be less than that above the container end of liquid-out aperture 20. In FIG. 3B, side-wall ls forms right angle θ with bottom-wall 1*b* of container 1, and the liquid level in container 1 is at height X above the top of liquid-out aperture 20. In this embodiment, the liquid pressure at the container end of air-back aperture 22 is less than the liquid pressure at the container end of liquid-out aperture 20 because the height of the liquid level above aperture 20 exceeds the height of the liquid level above aperture 22 by distance h, as shown.

In FIG. 3C, side-wall $1s^1$ forms oblique angle $\theta_1$ with bottom-wall $1b_1$ of container 11, and the liquid level in container 11 again is at height X above the top of liquid-out aperture 20. In this embodiment, the liquid pressure at the container end of air-back aperture 22 is less than the liquid pressure at the container end of liquid-out aperture 20 because the height of the liquid level above aperture 20 exceeds the height of the liquid level above aperture 22 by a distance hsin $\theta_1$, as shown.

Without an extension tube, the difference between the liquid pressure at aperture 20 and the liquid pressure at aperture 22 will be less in the embodiment shown in FIG. 3C than in the embodiment shown in FIG. 3B because distance hsin $\theta_1$ will always be less than distance h. However, when valve housing 12 is provided with an extension tube 23 having a length l, the difference between the liquid pressure at aperture 20 and the liquid pressure at aperture 22 in FIG. 3C increases because the difference between the height of the liquid level above aperture 22 and the height of the liquid level above aperture 20 increases by a distance l cos $\theta_1$, as shown. If extension tube 23 is provided, the tops of apertures 20 and 22 need not be separated by a distance h, because distance l cos $\theta_1$ allows the liquid pressure at the container end of air-back aperture 22 to be less than the liquid pressure at the container end of liquid-out aperture 20. Extension tube 23 may be integrally molded as part of valve housing 12 or it may be part of a separate assembly. The length and diameter of extension tube 23 may be chosen to provide the most user-friendly range of liquid outflow rates based upon the angle between the side-wall and bottom-wall of the container, the volume and rigidity of the container, and the liquid to be dispensed. Extension tube 23 does not affect the difference between the liquid pressure at aperture 20 and the liquid pressure at aperture 22 in FIG. 3B. Therefore, in the configuration shown in FIG. 3B, extension tube 23 would be of no use. However, extension tube 23 may be upwardly curved to affect the difference between the liquid pressure at aperture 20 and the liquid pressure at aperture 22 in FIG. 3B. It should be noted that a higher extension tube allows more air flow up into the container, but only until the point where the inflow volume of air through the valve assembly matches the maximum outflow volume of liquid through the valve assembly. Furthermore, it should be noted that when the valve assembly is used with a collapsible container, such as a balloon or bag, for example, the magnitude of the partial vacuum created above the liquid level inside the container decreases, thereby reducing the need for air to be drawn into the container through the air-back passageway.

Preferably, and as shown in FIGS. 1–3C, housing 12 includes top flanges 17 to provide the user with a grip in order to move the valve assembly and container in a refrigerator or on a counter, for example. If a handle is only provided on the top of the container, the lack of a grip area on the front of the container may sometimes force the user to use valve housing 12 as a handle in order to move the container. Flanges 17 preferably give the user's thumb a place to grip as his or her fingers wrap around the back and bottom of housing 12 to facilitate movement of the container.

Figure 2:
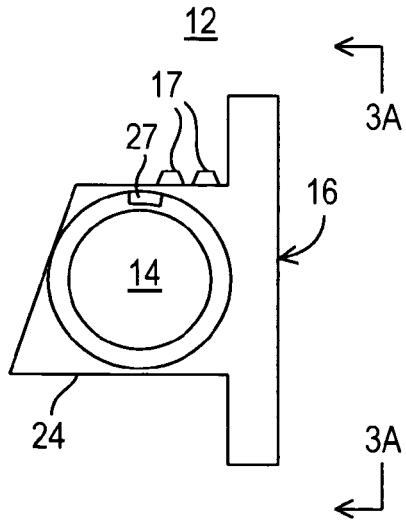
FIG. 2 is a side elevational view of the valve housing of FIG. 1, taken from line 2—2 of FIG. 1.

As seen in FIGS. 4–8, valve core 32 preferably includes a substantially cylindrical and hollow valve core body 34 having a longitudinal axis Al (which when assembled with valve housing 12 preferably is substantially coincident with axis A of FIGS. 1–3). There is also attached at one end a handle or actuator 36, which preferably is substantially perpendicular to the longitudinal axis Al of core body 34. Preferably, a liquid-out passageway 38 (see FIGS. 16–37) is formed within core body 34, between an exterior-facing opening 40 and a container-facing opening 42, which are formed through the peripheral surface of core body 34. In a preferred embodiment, exterior-facing opening 40 is substantially semicircular, having a diameter $D_1$, and container-facing opening 42 is substantially rectangular, having a height $H_1$ and a length $L_1$, as shown. An air channel 46 preferably is formed into the peripheral surface of core body 34 to form an air-back passageway 44 about core body 34 (see FIGS. 17–37) when core 32 is assembled with housing 12 to form a valve assembly of the present invention. In a preferred embodiment, air channel 46 is formed into the surface of core body 34 to a depth t, and extends circumferentially about core body 34 from a first end j to a second end k. Preferably, channel 46 is wider at second end k than at first end j such that a portion of channel 46 at second end k extends away from handle 36 to at least a point Z along the length of core body 34, for reasons to be explained below.

Core body 34 is shown to extend along longitudinal axis $A_1$, from a preferably open end 33, past openings 40 and 42, and air channel 46, to a closed end 35 shared by handle 36, although end 33 may conceivably be closed in other embodiments. In a more particularly preferred embodiment, core 32 includes an actuation track 37. Track 37 is formed into the periphery of handle 36 closest to end 35, from a point F to a point E, for limiting the actuation range of core 32 within body portion 14 (described in more detail below). Like valve body portion 14, valve core 32 may be formed from any suitable material such as high-density polyethylene, low-density polyethylene, polypropylene, linear low-density polyethylene, or other polymer, and preferably is of the same material as body portion 14. It should be noted that core body 34 described above is only exemplary and need not be hollow, and that, in an other embodiment (not shown), core body 34 could be substantially solid and the passageways could be formed through and/or about the solid of the core body.

FIGS. 9–37 show how valve housing 12 of FIGS. 1–3C and valve core 32 of FIGS. 4–8 may be combined to form valve assembly 10 of the present invention. Preferably, core body 34 creates a seal within the hollow of cylindrical body portion 14 and is rotatable about longitudinal axis A, which is shared by core body 34 and body portion 14. Through rotation of handle 36 about axis A, and therefore through rotation of core body 34 within body portion 14, the geometry of housing 12 and core 32 (described above) preferably regulates not only the flow of liquid from a container, through liquid-out aperture 20, liquid-out passageway 38, and spout 24 to the user, but also the supply of external air through spout 24, air-back passageway 44, and air-back aperture 22 to the interior of the container above the liquid level. Once a partial vacuum is created inside the container, this geometry also preferably provides a seal between the housing and the core that is sufficient to substantially maintain the partial vacuum inside the container after the valve is closed. Valve assembly 10 may provide the liquid and air-tight seal between the elements of housing 12 and core 32, and between the container and its ambient environment, through the use of standard surface-to-surface interference fits or through the use of gaskets, such as molded seal beads around the ends of the core body and at the perimeter of each end of each passageway (not shown for the sake of clarity of the drawings), for example.

Figure 9:
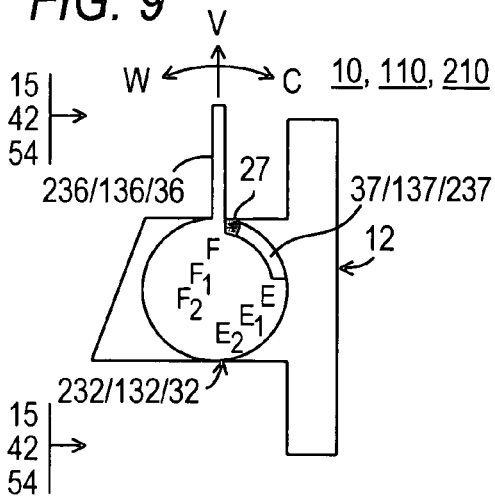
FIGS. 9–14 are side views of an assembled valve of the present invention in various stages of actuation.

FIGS. 9–13 are end views of valve assembly 10 having core 32 rotated to five different positions, as indicated by the orientations of handle 36. FIG. 9 shows valve assembly 10 in a "closed" position. In this position, handle 36 is shown to have essentially a 0° actuation angle with respect to a vertical line V that is substantially perpendicular to axis A (not shown), ("vertical" being understood in the sense of FIGS. 9–13; the actual angle will be a function of the incline of the surface of the container to which valve assembly 10 is attached (see FIGS. 3B and 3C)). As seen by the orientation of handle 36 in FIG. 9, the interaction of actuation stop 27 with point F of actuation track 37 preferably prevents handle 36 from rotating beyond this position in direction C.

Figure 10:
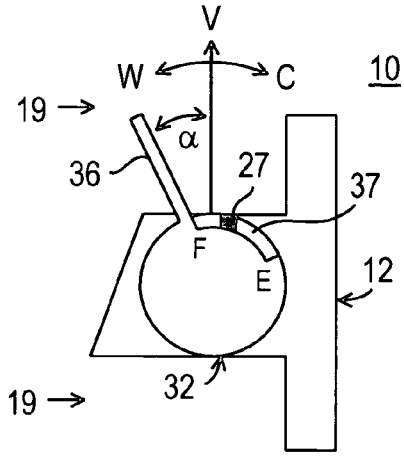
Figure 11:
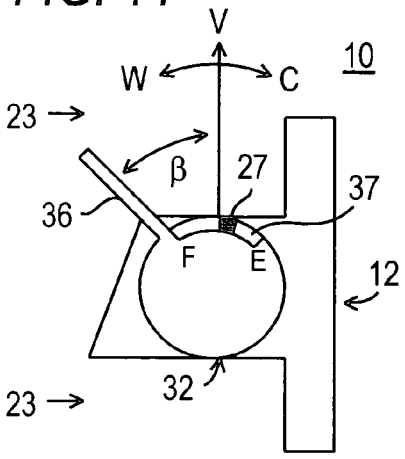
Figure 12:
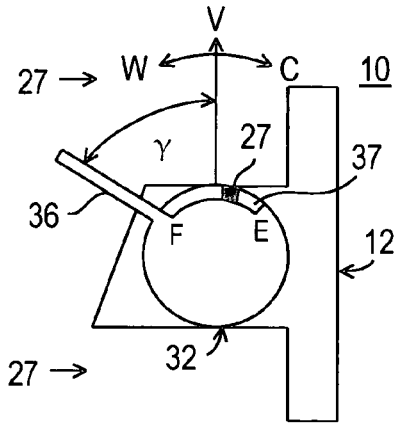
Figure 13:
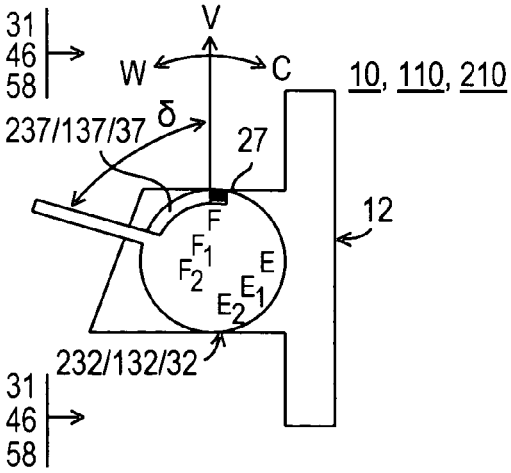

FIG. 10 shows valve assembly 10 in a "minimally ON" position, in which handle 36 has been rotated in direction W or C about axis A to an actuation angle $\alpha$ with respect to V. FIG. 11 shows valve assembly 10 in a "halfway ON" position, in which handle 36 has been rotated in direction W or C about axis A to an actuation angle $\beta$ with respect to V. FIG. 12 shows valve assembly 10 in a "significantly ON" position, in which handle 36 has been rotated in direction W or C about axis A to an actuation angle $\gamma$ with respect to V. FIG. 13 shows valve assembly 10 in a "completely ON" position, in which handle 36 has been rotated in direction W about axis A to an actuation angle $\delta$ with respect to V. As seen in this drawing, the interaction between actuation stop 27 and point E of actuation track 37 preferably prevents handle 36 from rotating further in direction W, so that handle 36 may not rotate to an actuation angle that allows the handle to interfere with the receptacle that the user is filling with liquid, for example.

Figure 14:
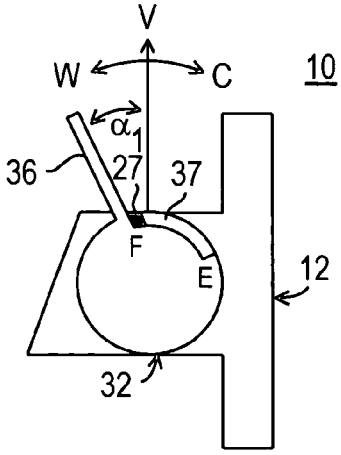
Figure 15:
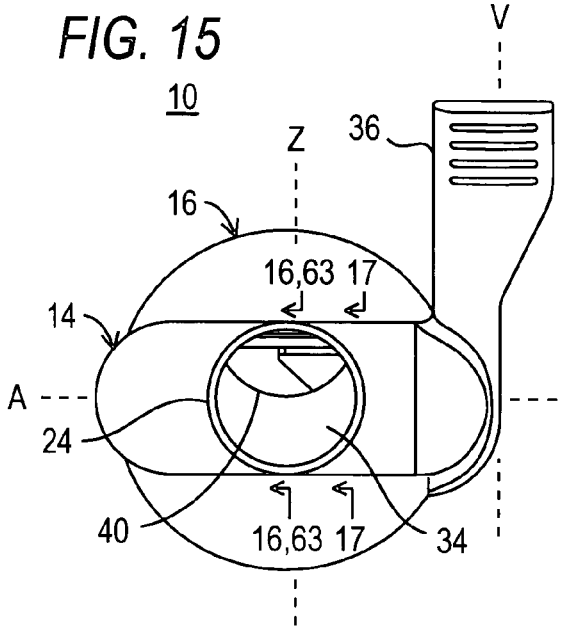
FIG. 15 is a front elevational view of the valve assembly of FIGS. 9–14, in the stage of actuation represented by FIG. 9, taken from line 15—15 of FIG. 9.
Figure 18:
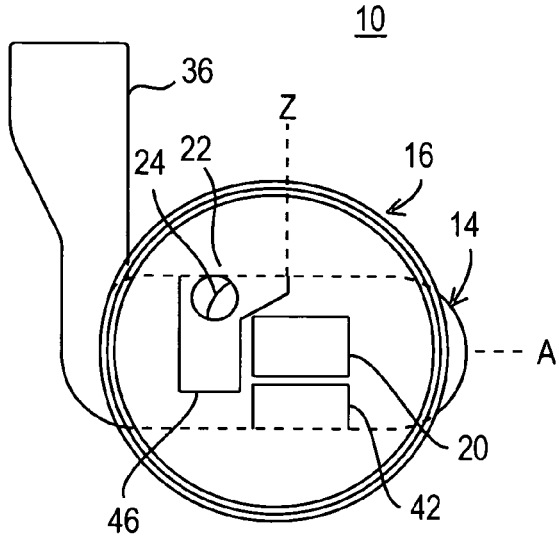
FIG. 18 is a rear elevational view of the valve assembly of FIGS. 9–17, taken from line 18—18 of FIG. 16, but with most of the fitment element omitted.

In a more preferred embodiment, shown in FIG. 14, the "closed" position may be defined by handle 36 forming an actuation angle greater than 0° (i.e., $\alpha_1$) with respect to V. This may be desirable when the surface of the container closest to the valve assembly makes it difficult for a user to grasp a handle that is vertically aligned with the valve (see FIG. 9). This may be accomplished easily by forming handle 36 and actuation track 37 at a different circumferential position (as compared to FIG. 9) on valve core body 34, and by forming actuation stop 27 at a correspondingly different position (as compared to FIG. 9) on housing portion 14, such that when actuation stop 27 contacts point F of track 37, handle 36 forms the desired angle with respect to V. This feature allows the core to be grippable and actuatable in all positions that could be used while dispensing liquid. In yet another embodiment (not shown), it may be desirable for the "completely ON" position to be defined by handle 36 forming an actuation angle less than angle δ with respect to V, so that the handle is less likely to interfere with the receptacle being filled. This may be accomplished by forming handle 36 and actuation track 37 at a different circumferential position (as compared to FIG. 13) on valve core body 34, and by forming actuation stop 27 at a corresponding different position (as compared to FIG. 13) on housing portion 14, as described above with respect to FIG. 14, but such that when actuation stop 27 contacts point E of track 37, handle 36 forms the desired angle with respect to V. In this embodiment, the shape of the container may be modified so that it is easier for the user to grasp the handle when the valve assembly is in the "closed" position.

Figure 16:
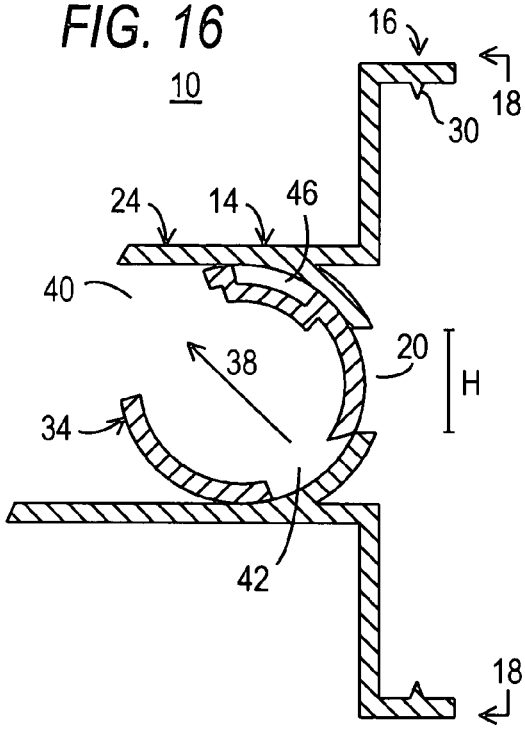
FIG. 16 is a vertical cross-sectional view of the valve assembly of FIGS. 9–15, taken from line 16—16 of FIG. 15.
Figure 17:
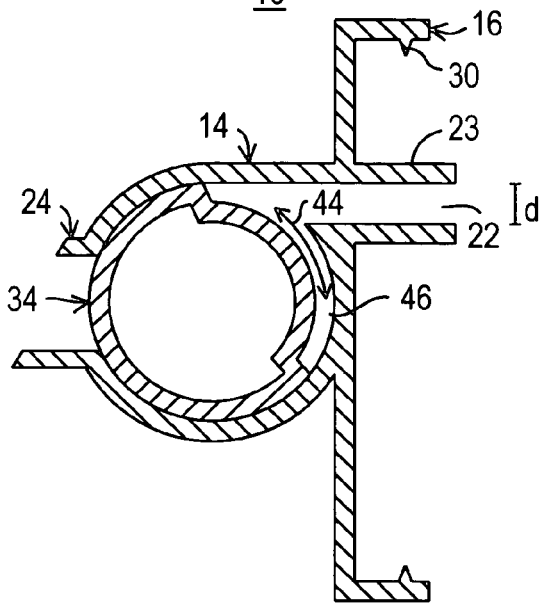
FIG. 17 is a vertical cross-sectional view of the valve assembly of FIGS. 9–16, taken from line 17—17 of FIG. 15.
Figure 19:
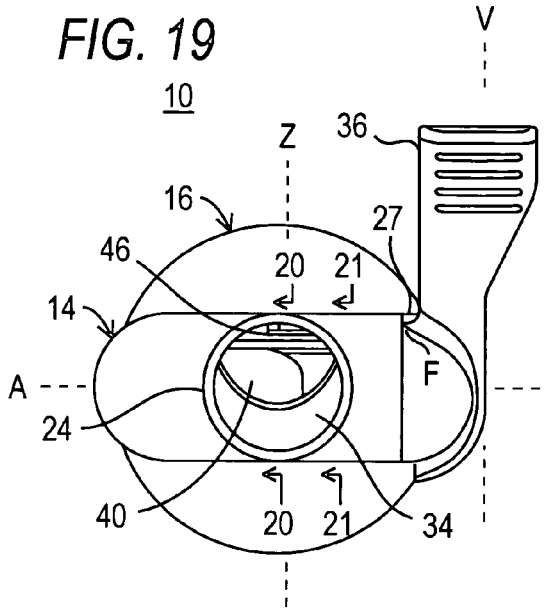
FIG. 19 is a front elevational view of the valve assembly of FIGS. 9–18, similar to FIG. 15, but in the stage of actuation represented by FIG. 10, taken from line 19—19 of FIG. 10.
Figure 22:
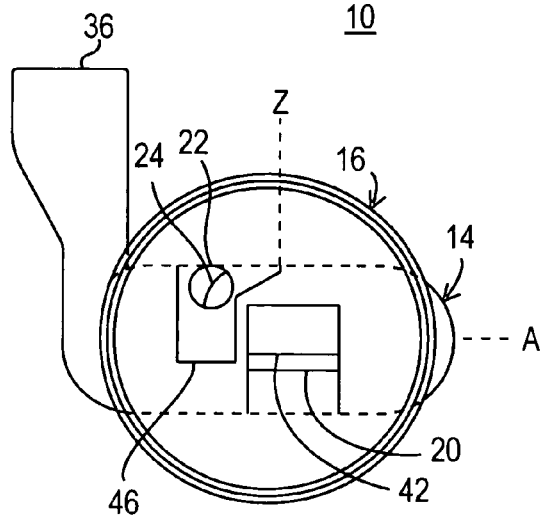
FIG. 22 is a rear elevational view of the valve assembly of FIGS. 9–21, taken from line 22—22 of FIG. 20, but with most of the fitment element omitted.

FIGS. 15–18 show a preferred embodiment of valve assembly 10 in the closed position. Preferably, in this closed position, no portion of container-facing opening 42 is aligned with any portion of liquid-out aperture 20, as shown in FIG. 16. Therefore, no liquid flows through liquid-out passageway 38 within core body 34 between liquid-out aperture 20 and spout 24. Furthermore, no portion of air channel 46 is exposed to any portion of spout 24, as shown in FIGS. 16 and 17, thereby preventing air-back passageway 44 from allowing the movement of air or liquid between spout 24 and air-back aperture 22. Although one end of each of passageways 38 and 44 as shown is always substantially completely open (i.e., substantially all of exterior-facing opening 40 is aligned with spout 24, and substantially all of air-back aperture 22 is aligned with channel 46), other embodiments are envisioned without departing from the scope of the present invention wherein, for example, both ends of each passageway open gradually as the actuation angle grows with respect to V.

Figure 20:
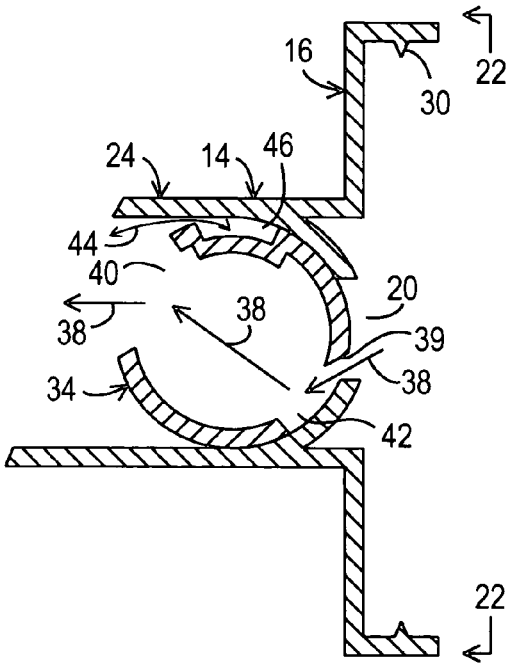
FIG. 20 is a vertical cross-sectional view of the valve assembly of FIGS. 9–19, taken from line 20—20 of FIG. 19.
Figure 21:
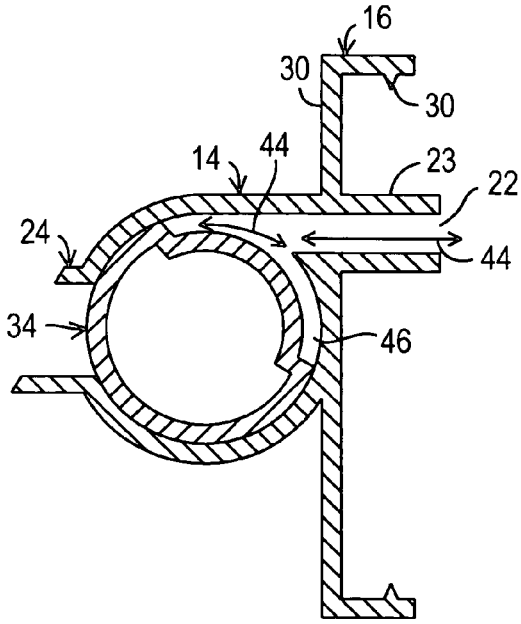
FIG. 21 is a vertical cross-sectional view of the valve assembly of FIGS. 9–20, taken from line 21—21 of FIG. 19.
Figure 23:
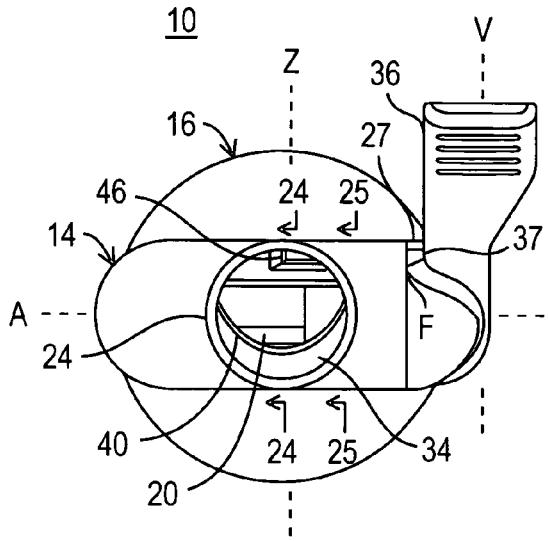
FIG. 23 is a front elevational view of the valve assembly of FIGS. 9–22, similar to FIGS. 15 and 19, but in the stage of actuation represented by FIG. 11, taken from line 23—23 of FIG. 11.
Figure 26:
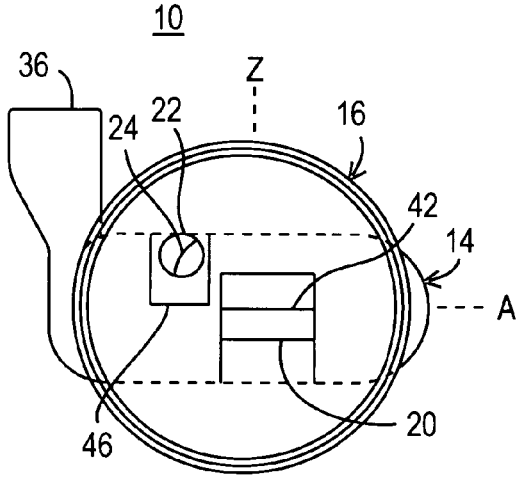
FIG. 26 is a rear elevational view of the valve assembly of FIGS. 9–25, taken from line 26—26 of FIG. 24, but with most of the fitment element omitted.

FIGS. 19–22 are views similar to FIGS. 15–18, respectively, but show valve assembly 10 in the "minimally ON" position that is shown in FIG. 10. Preferably, in this minimally ON position, core body 34 has been rotated to align both a minimal portion of container-facing opening 42 with a portion of liquid-out aperture 20 and substantially all of exterior-facing opening 40 with spout 24, as shown in FIG. 20, thereby allowing liquid to flow between liquid-out aperture 20 and spout 24 through liquid-out passageway 38. Furthermore, in this minimally ON position, core body 34 preferably has been rotated to align air channel 46 with both a relatively minimal portion of spout 24, as shown in FIG. 20 by the portion of channel 46 that extends to at least point Z, and substantially all of air-back aperture 22, as shown in FIG. 21, thereby allowing fluid to flow between air-back aperture 22 and spout 24 through air-back passageway 44. Core body 34 may have additional geometry that further aids the dispensing of liquid from valve assembly 10. For example, container-facing opening 42 may be formed through the peripheral surface of core body 34 such that "top" edge 39 of opening 42 is not radial, but instead is chamfered relative to the outer periphery of core body 34, as shown in FIG. 20, to guide liquid downwardly from a container through opening 42 to provide more control to the flow of liquid through liquid-out passageway 38.

Figure 24:
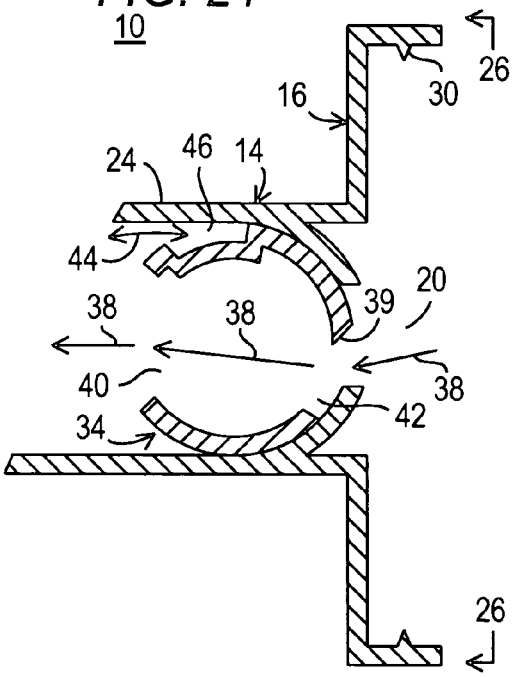
FIG. 24 is a vertical cross-sectional view of the valve assembly of FIGS. 9–23, taken from line 24—24 of FIG. 23.
Figure 25:
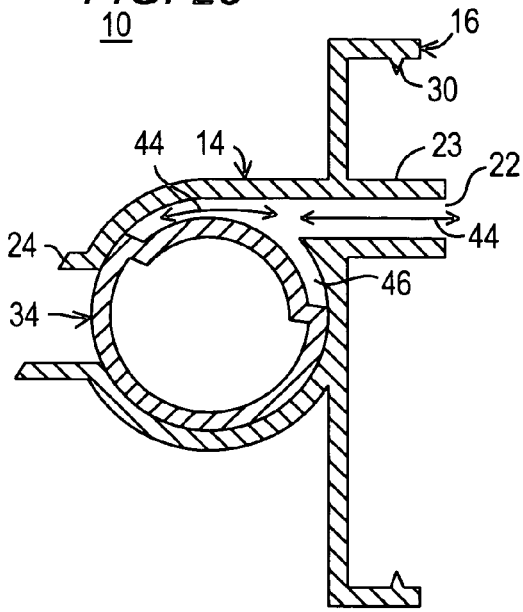
FIG. 25 is a vertical cross-sectional view of the valve assembly of FIGS. 9–24, taken from line 25—25 of FIG. 23.
Figure 27:
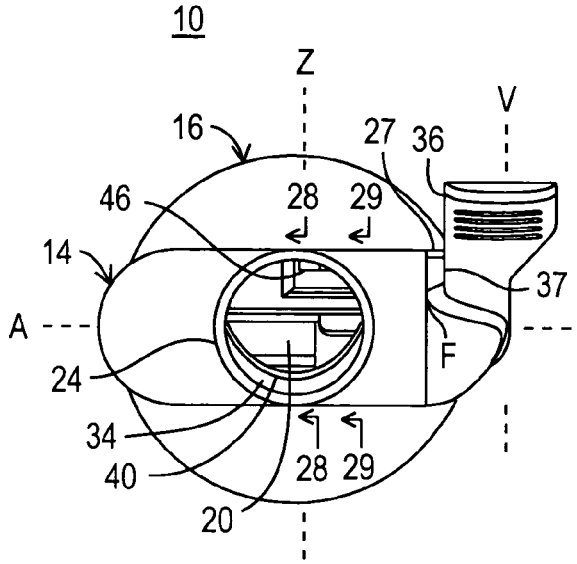
FIG. 27 is a front elevational view of the valve assembly of FIGS. 9–26, similar to FIGS. 15, 19, and 23, but in the stage of actuation represented by FIG. 12, taken from line 27—27 of FIG. 12.
Figure 30:
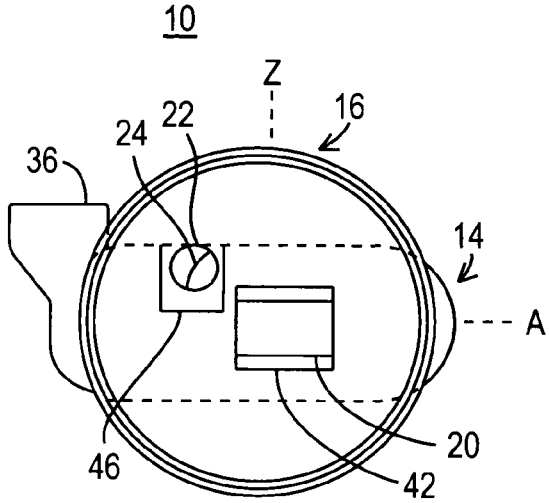
FIG. 30 is a rear elevational view of the valve assembly of FIGS. 9–29, taken from line 30—30 of FIG. 28, but with most of the fitment element omitted.

FIGS. 23–26 are similar to FIGS. 15–18, respectively, but show valve assembly 10 in the "halfway ON" position that is shown in FIG. 11. Preferably, in this halfway ON position, core body 34 has been rotated to align both substantially half of container-facing opening 42 with liquid-out aperture 20 and substantially all of exterior-facing opening 40 with spout 24, as shown in FIG. 24, thereby allowing liquid to flow between liquid-out aperture 20 and spout 24 through liquid-out passageway 38. Furthermore, in this halfway ON position, core body 34 preferably has been rotated to align air channel 46 with both a bigger portion of the spout (compared to that in the "minimally ON" position), as shown in FIG. 24 by the portion of channel 46 that extends to at least point Z, and substantially all of air-back aperture 22, as shown in FIG. 25, thereby allowing fluid to flow between air-back aperture 22 and spout 24 through air-back passageway 44.

Figure 28:
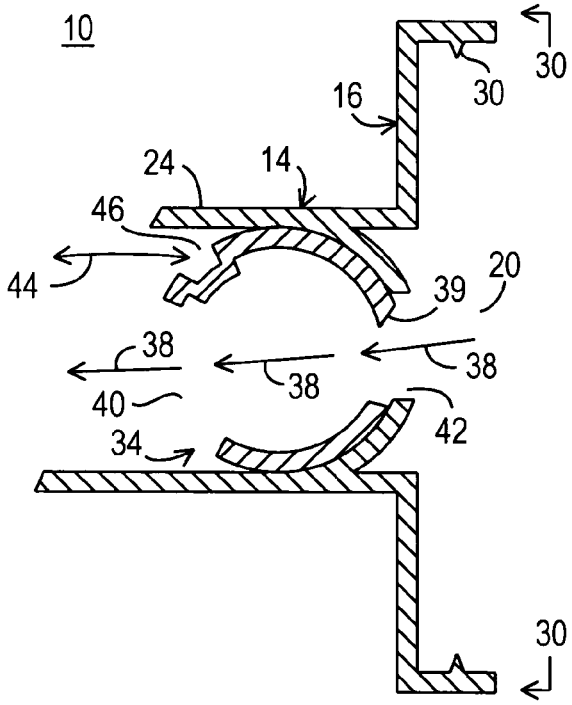
FIG. 28 is a vertical cross-sectional view of the valve assembly of FIGS. 9–27, taken from line 28—28 of FIG. 27.
Figure 29:
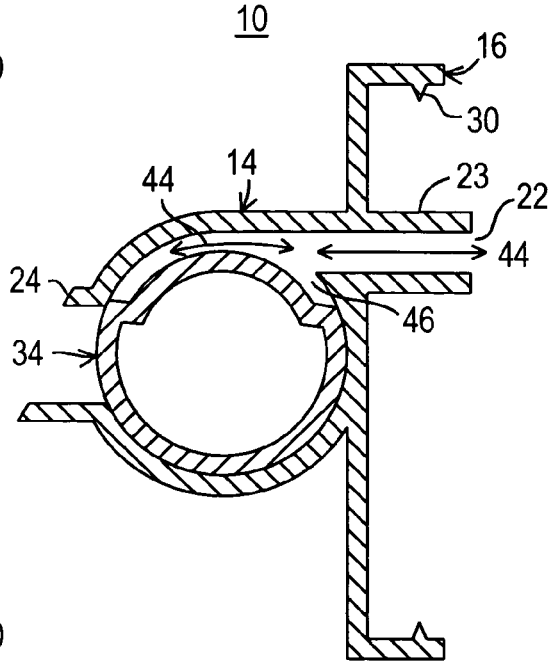
FIG. 29 is a vertical cross-sectional view of the valve assembly of FIGS. 9–28, taken from line 29—29 of FIG. 27.
Figure 31:
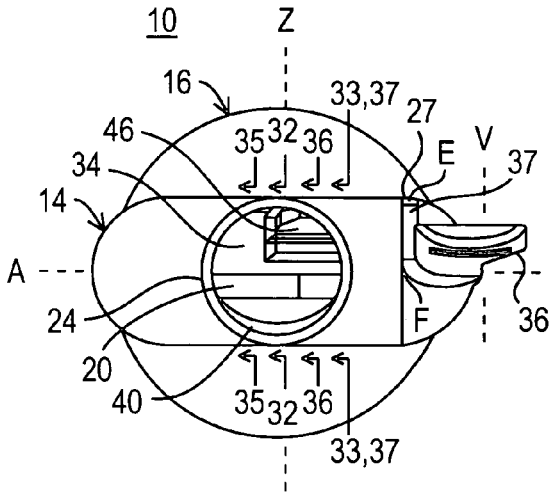
FIG. 31 is a front elevational view of the valve assembly of FIGS. 9–30, similar to FIGS. 15, 19, 23, and 27, but in the stage of actuation represented by FIG. 13, taken from line 31—31 of FIG. 13.
Figure 34:
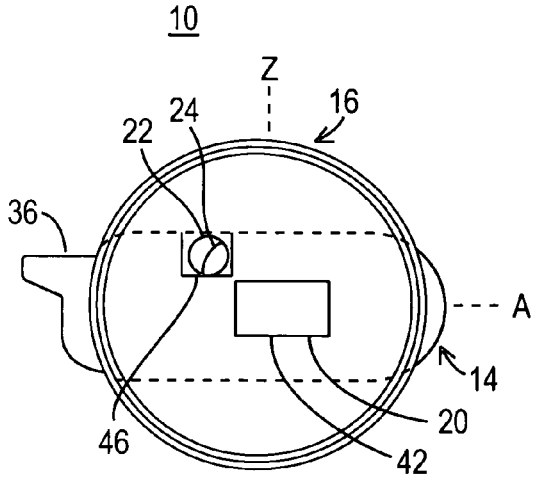
FIG. 34 is a rear elevational view of the valve assembly of FIGS. 9–33, taken from line 34—34 of FIG. 32, but with most of the fitment element omitted.

FIGS. 27–30 are similar to FIGS. 15–18, respectively, but show valve assembly 10 in the "significantly ON" position that is shown in FIG. 12. Preferably, in this significantly ON position, core body 34 has been rotated to align both a significant portion of container-facing opening 42 with liquid-out aperture 20 and substantially all of exterior-facing opening 40 with spout 24, as shown in FIG. 28, thereby allowing liquid to flow between liquid-out aperture 20 and spout 24 through liquid-out passageway 38. Furthermore, in this significantly ON position, core body 34 preferably has been rotated to align air channel 46 with both a bigger portion of the spout (compared to that in the "halfway ON" position), as shown in FIG. 28 by the portion of channel 46 that extends to at least point Z, and substantially all of air-back aperture 22, as shown in FIG. 29, thereby allowing fluid to flow between air-back aperture 22 and spout 24 through air-back passageway 44.

Figure 32:
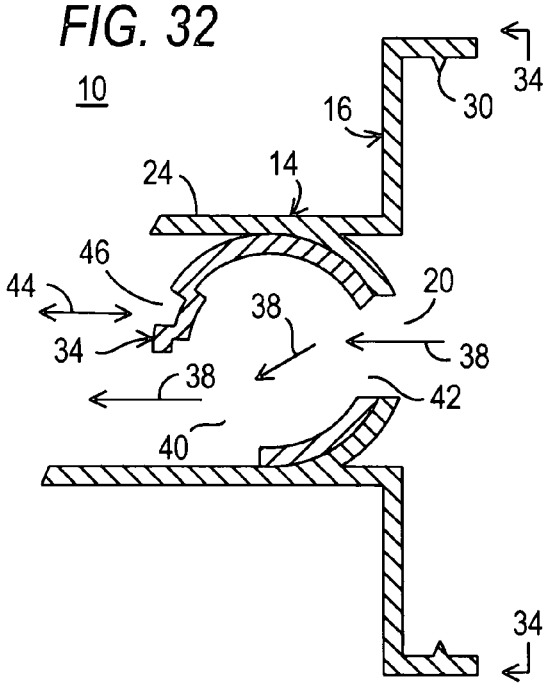
FIG. 32 is a vertical cross-sectional view of the valve assembly of FIGS. 9–31, taken from line 32—32 of FIG. 31.
Figure 33:
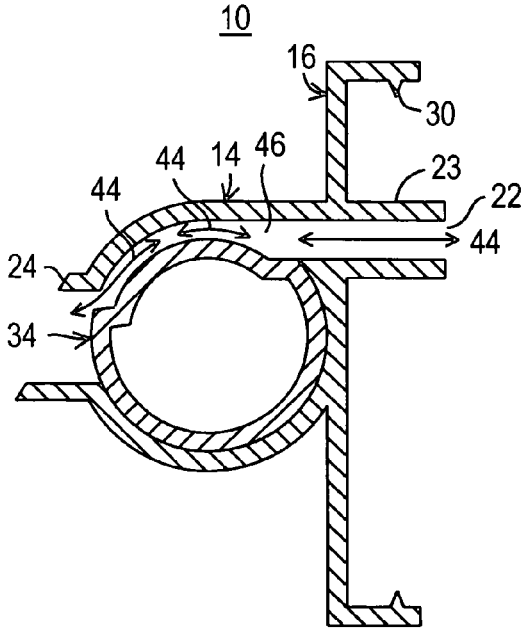
FIG. 33 is a vertical cross-sectional view of the valve assembly of FIGS. 9–32, taken from line 33—33 of FIG. 31.
Figure 36:
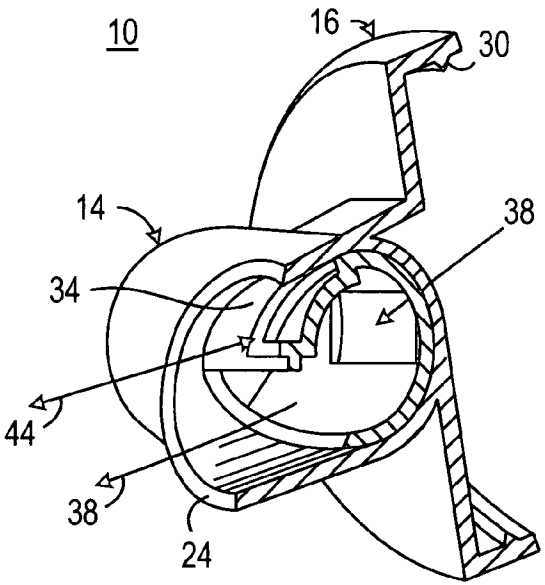
FIG. 36 is a partially sectional perspective view of the valve assembly of FIGS. 9–35, taken from line 36—36 of FIG. 31.
Figure 37:
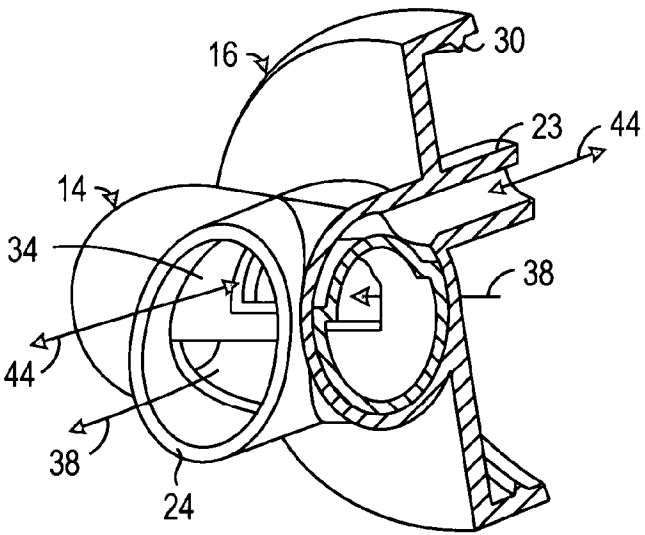
FIG. 37 is a partially sectional perspective view of the valve assembly of FIGS. 9–36, taken from line 37—37 of FIG. 31.
Figure 35:
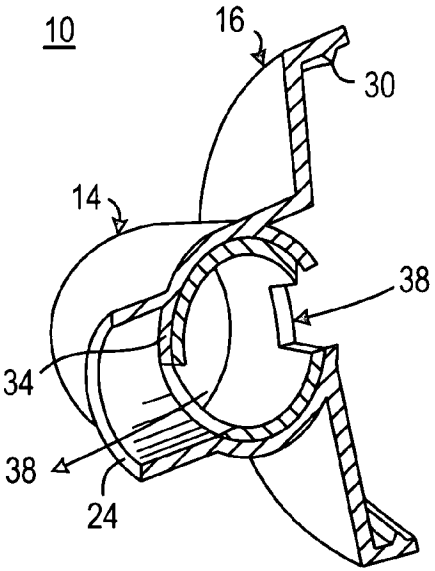
FIG. 35 is a partially sectional perspective view of the valve assembly of FIGS. 9–34, taken from line 35—35 of FIG. 31.
Figure 38:
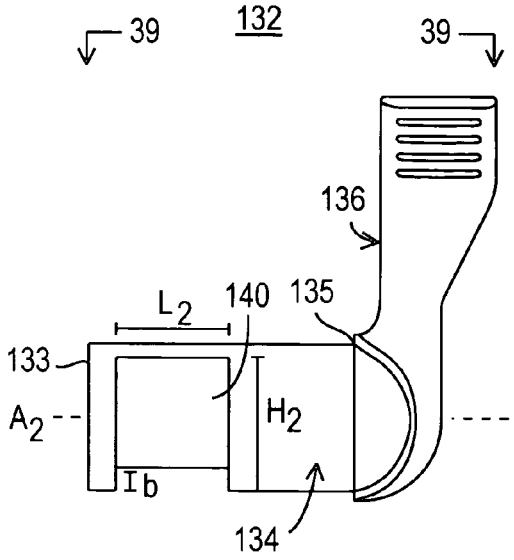
FIG. 38 is a side elevational view of a second embodiment of a valve core according to the present invention.
Figure 39:
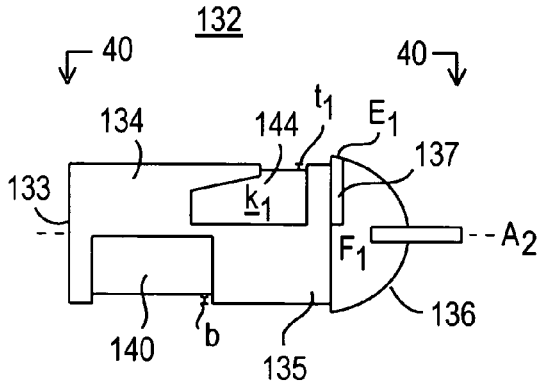
FIG. 39 is a side elevational view of the valve core of FIG. 38, taken from line 39—39 of FIG. 38.
Figure 40:
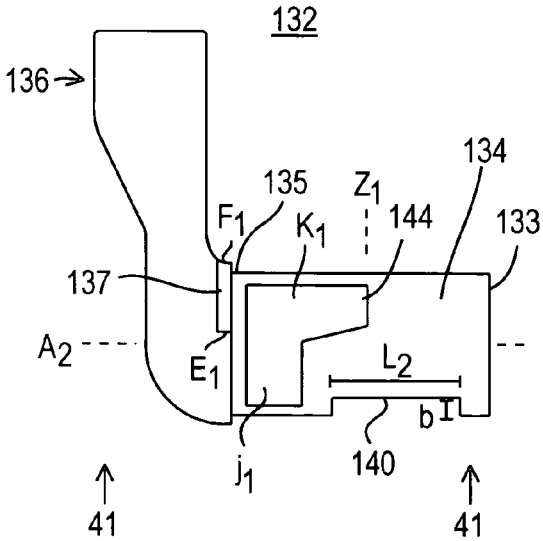
FIG. 40 is a side elevational view of the valve core of FIGS. 38 and 39, taken from line 40—40 of FIG. 39.
Figure 41:
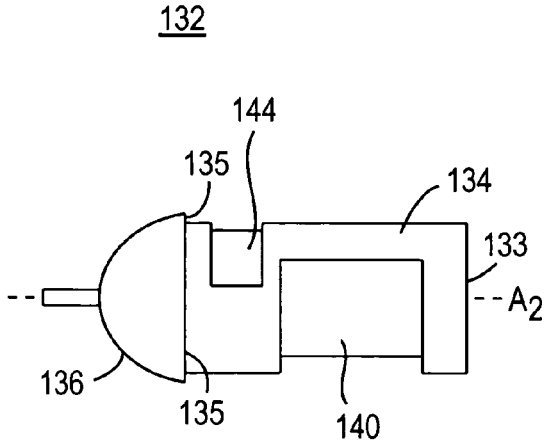
FIG. 41 is a side elevational view of the valve core of FIGS. 38–40, taken from line 41—41 of FIG. 40.
Figure 42:
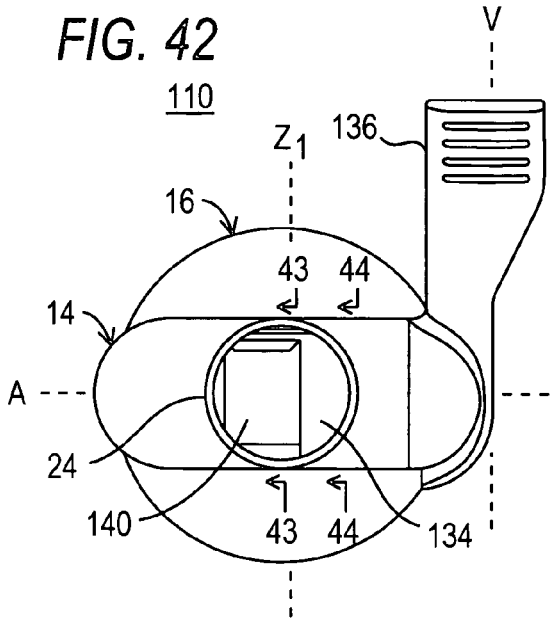
FIG. 42 is a front elevational view, similar to FIG. 15, of a second embodiment of a valve assembly according to the present invention, incorporating the core of FIGS. 38–41, in the stage of actuation represented by FIG. 9, taken from line 42—42 of FIG. 9.
Figure 45:
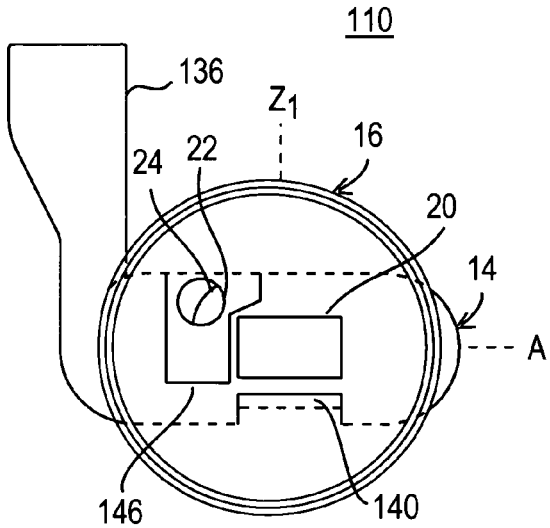
FIG. 45 is a rear elevational view of the valve assembly of FIGS. 42–44, taken from line 45—45 of FIG. 43, but with most of the fitment element omitted.
Figure 43:
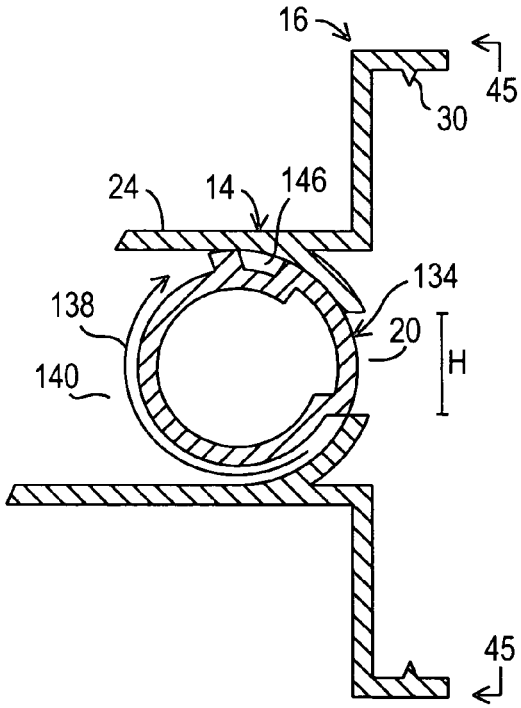
FIG. 43 is a vertical cross-sectional view of the valve assembly of FIG. 42, taken from line 43—43 of FIG. 42.
Figure 44:
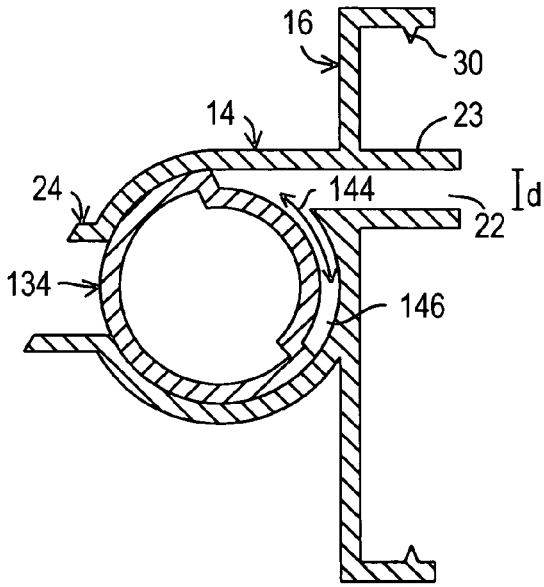
FIG. 44 is a vertical cross-sectional view of the valve assembly of FIGS. 42 and 43, taken from line 44—44 of FIG. 42.
Figure 46:
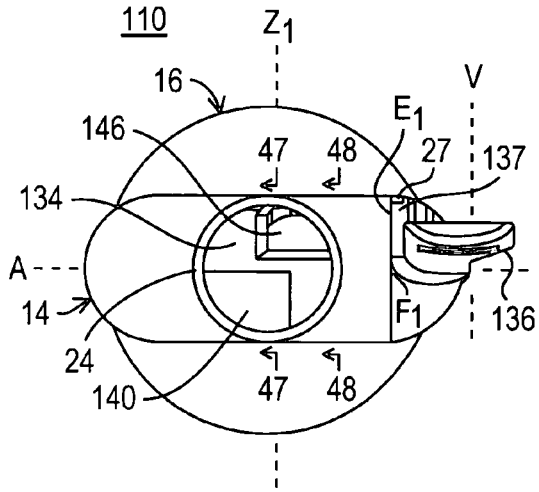
FIG. 46 is a front elevational view of the valve assembly of FIGS. 42–45, similar to FIG. 42, but in the stage of actuation represented by FIG. 13, taken from line 46—46 of FIG. 13.
Figure 49:
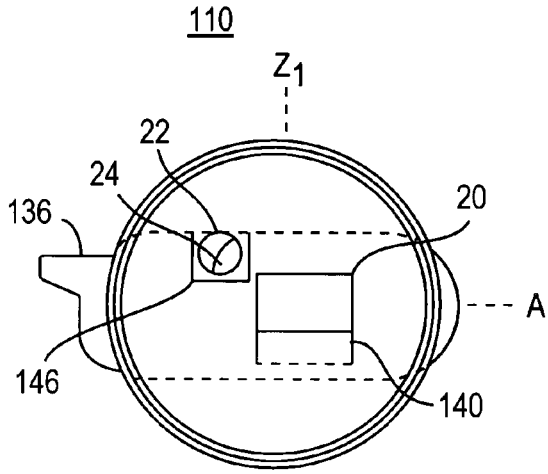
FIG. 49 is a rear elevational view of the valve assembly of FIGS. 42–48, taken from line 49—49 of FIG. 47, but with most of the fitment element omitted.
Figure 47:
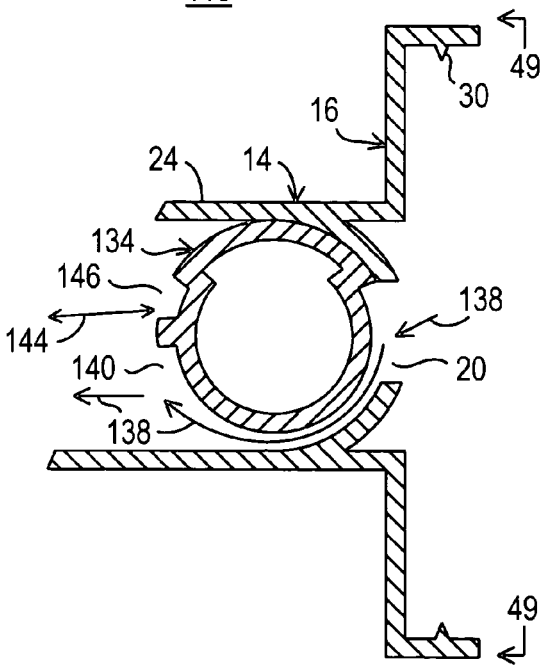
FIG. 47 is a vertical cross-sectional view of the valve assembly of FIGS. 42–46, taken from line 47—47 of FIG. 46.
Figure 48:
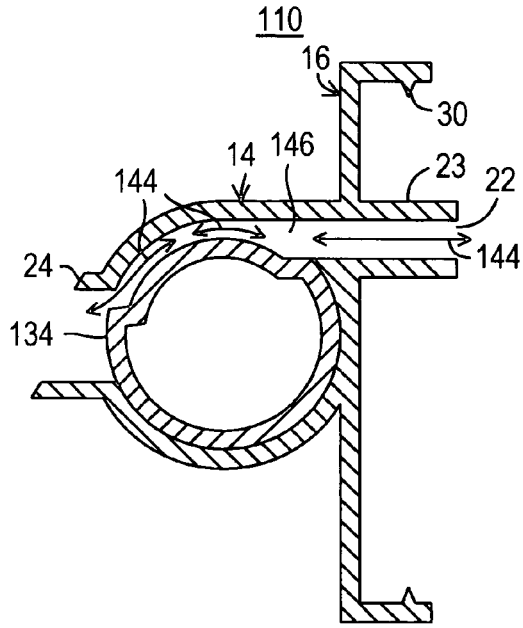
FIG. 48 is a vertical cross-sectional view of the valve assembly of FIGS. 43–47, taken from line 48—48 of FIG. 46.
Figure 50:
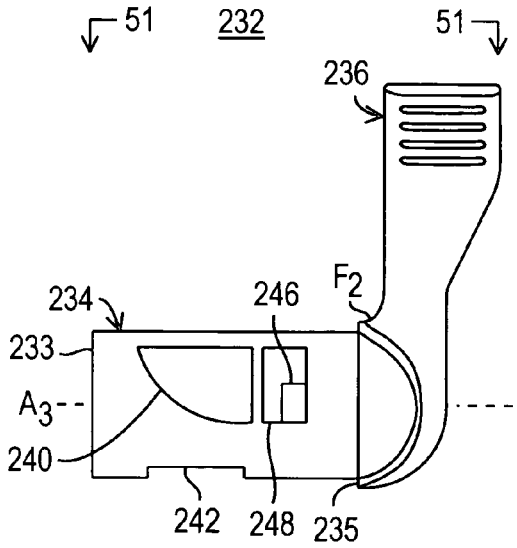
FIG. 50 is a side elevational view of a third embodiment of a valve core according to the present invention.
Figure 51:
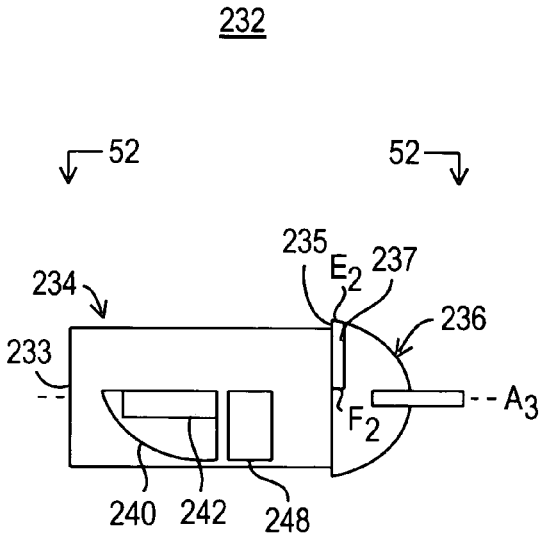
FIG. 51 is a side elevational view of the valve core of FIG. 50, taken from line 51—51 of FIG. 50.
Figure 52:
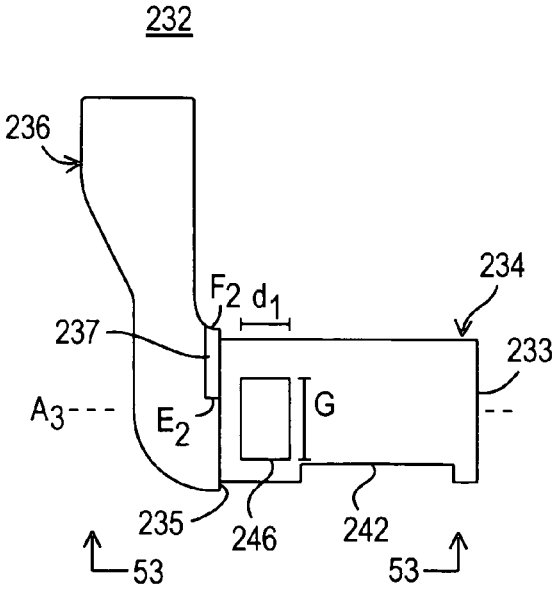
FIG. 52 is a side elevational view of the valve core of FIGS. 50 and 51, taken from line 52—52 of FIG. 51.
Figure 53:
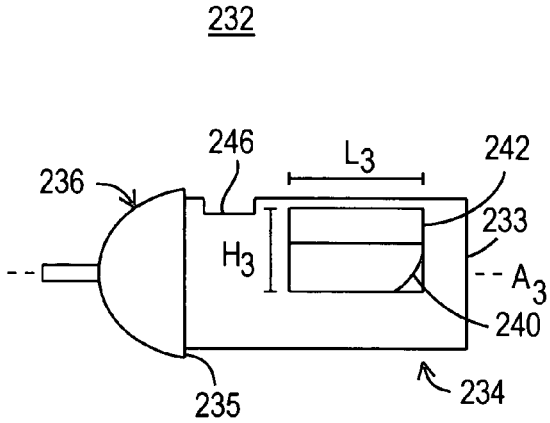
FIG. 53 is a side elevational view of the valve core of FIGS. 50–52, taken from line 53—53 of FIG. 52.
Figure 54:
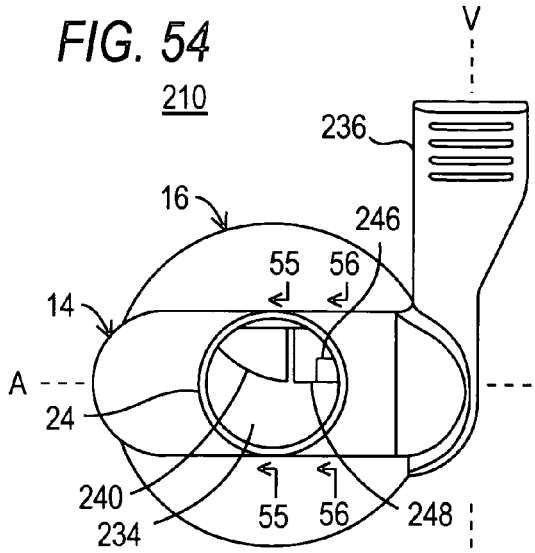
FIG. 54 is a front elevational view, similar to FIG. 15, of a third embodiment of a valve assembly according to the present invention, incorporating the core of FIGS. 50–53, in the stage of actuation represented by FIG. 9, taken from line 54—54 of FIG. 9.
Figure 57:
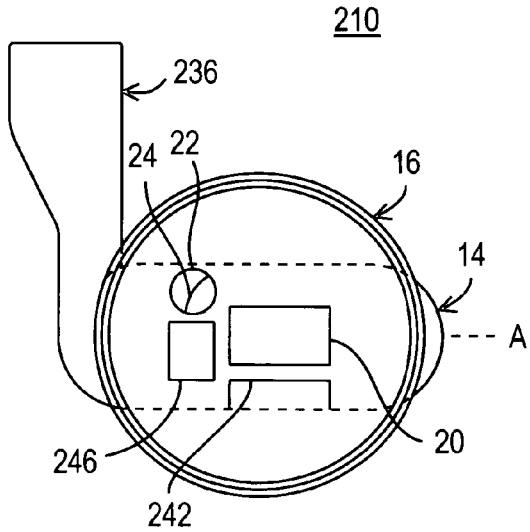
FIG. 57 is a rear elevational view of the valve assembly of FIGS. 54–56, taken from line 57—57 of FIG. 55, but with most of the fitment element omitted.
Figure 55:
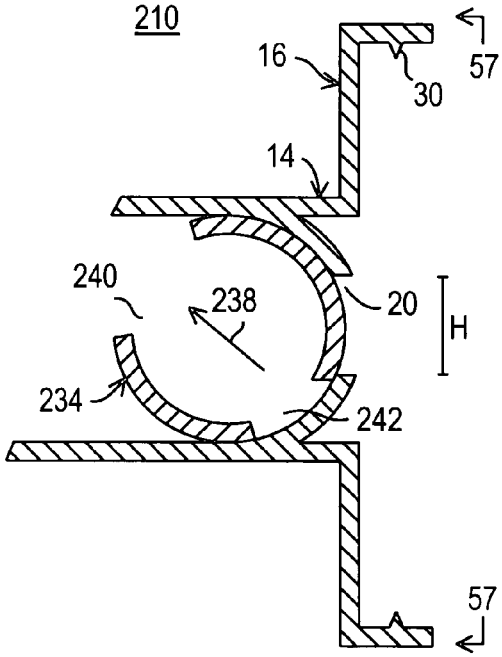
FIG. 55 is a vertical cross-sectional view of the valve assembly of FIG. 54, taken from line 55—55 of FIG. 54.
Figure 56:
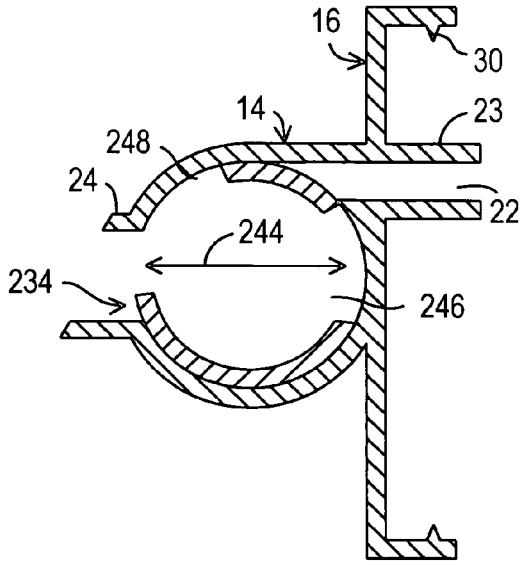
FIG. 56 is a vertical cross-sectional view of the valve assembly of FIGS. 54 and 55, taken from line 55—55 of FIG. 54.
Figure 58:
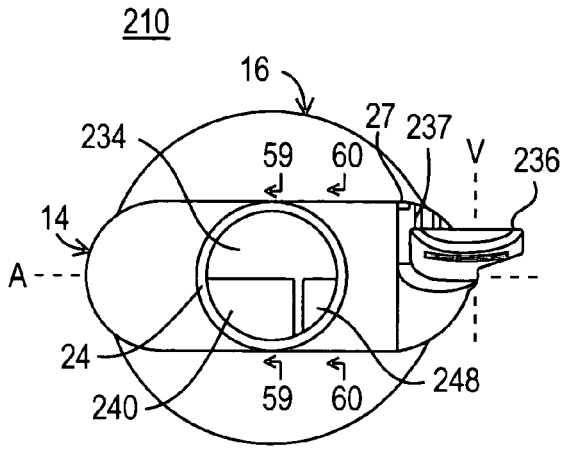
FIG. 58 is a front elevational view of the valve assembly of FIGS. 54–57, similar to FIG. 54, but in the stage of actuation represented by FIG. 13, taken from line 58—58 of FIG. 13.

FIGS. 31–34 are similar to FIGS. 15–18, respectively, but, along with FIGS. 35–37, show valve assembly 10 in the "completely ON" position that is shown in FIG. 13. Preferably, in this completely ON position, the interaction of actuation stop 27 and point E of actuation track 37 prevents handle 36 from rotating any further in direction W (see FIG. 13). Preferably, in this completely ON position, core body 34 has been rotated to align both substantially all of container-facing opening 42 with liquid-out aperture 20 and substantially all of exterior-facing opening 40 with spout 24, as shown in FIG. 32, thereby allowing liquid to flow between liquid-out aperture 20 and spout 24 through liquid-out passageway 38. Furthermore, in this completely ON position, core body 34 preferably has been rotated to align air channel 46 with both a bigger portion of the spout (compared to that in the "significantly ON" position), as shown in FIG. 32 by the portion of channel 46 that extends to at least point Z and as shown in FIG. 33, and substantially all of air-back aperture 22, as shown in FIG. 33, thereby allowing fluid to flow between air-back aperture 22 and spout 24 through air-back passageway 44.

Although substantially all of air-back aperture 22 is aligned with air channel 46, and substantially all of exterior-facing opening 40 is aligned with spout 24 throughout the rotation of core body 34 in the preferred embodiment of FIGS. 15–37, it is not outside the scope of the invention to provide a valve assembly with geometry such that both ends of passageway 38 and/or 44 align with different portions of the respective apertures and/or spout as the core body is rotated. Moreover, as is seen in FIGS. 15–37, it is preferable that the geometry of air channel 46 and apertures 20 and 22 is such that, in any of the positions described above (and any of the infinite positions therebetween), no portion of air channel 46 is aligned with any portion of liquid-out aperture 20. This ensures that nothing flowing out from liquid-out aperture 20 can flow back into the container through air-back aperture 22 via air-back passageway 44. Preferably, seals, such as those described above, are also provided to help ensure that liquid-out passageway 38 and air-back passageway 44 are substantially isolated from one another between apertures 20 and 22, and spout 24.

Valve core body 34, as shown in FIGS. 4–37, provides air-back passageway 44 along air channel 46 formed in its surface and liquid-out passageway 38 between openings 40 and 42 formed through its surface. However, in an alternate embodiment of a valve core body of the present invention, the two passageways may both be provided along channels in the surface of a core rotatable within valve housing 12 for aligning spout 24 with liquid-out aperture 20 and air-back aperture 22. Such an embodiment is shown in FIGS. 38–49.

Valve core 132, shown in FIGS. 38–41, preferably includes a substantially cylindrical valve core body 134 attached at one end to a handle 136 that preferably is substantially perpendicular to the longitudinal axis $A_2$ of core body 134. Preferably, a liquid-out passageway 138 (see FIGS. 43 and 47) is formed about core body 134, along a liquid channel 140 that is formed into the peripheral surface of core body 134. In a preferred embodiment, liquid channel 140 is formed into the surface of core body 134 to a depth b, and is substantially rectangular in shape, having a height $H_2$ and a length $L_2$, as shown, although many other shapes may be used without departing from the scope of the present invention. An air-back passageway 144 (see FIGS. 44, 47, and 48), similar to air-back passageway 44, is preferably formed about core body 134, along an air channel 146 that is formed into the peripheral surface of core body 134. In a preferred embodiment, air channel 146 is formed into the surface of core body 134 to a depth $t_1$, and extends circumferentially about core body 134 from a first end $j_1$ to a second end $k_1$. Preferably, air channel 146 is wider at second end $k_1$ than at first end $j_1$. In this preferred embodiment, a portion of air channel 146 extends away from handle 136 to at least a point $Z_1$ along the length of core 132.

Core body 134 is shown to extend substantially along longitudinal axis $A_2$, from end 133, past liquid channel 140 and air channel 146, to a closed end 135 shared by handle 136. In a more particularly preferred embodiment, core 132 includes an actuation track 137. Track 137 is formed into the periphery of handle 136 closest to end 135, from a point $F_1$ to a point $E_1$, for limiting the rotation range of core 132 within a valve housing (as described above with reference to actuation track 37). Like valve core 32, valve core 132 may be formed from any suitable material such as high-density polyethylene, low-density polyethylene, polypropylene, or linear low-density polyethylene, and preferably is formed of the same material as body portion 14.

FIGS. 42–49 show how valve housing 12 of FIGS. 1–3C and valve core 132 of FIGS. 38–41 may be combined to form valve assembly 110 of the present invention. FIGS. 42–45 are similar to FIGS. 15–18, respectively, and FIGS. 46–49 are similar to FIGS. 31–34, respectively, but represent valve assembly 110 instead of valve assembly 10.

Valve core body 34, as shown in FIGS. 4–37, provides air-back passageway 44 along air channel 46 formed in its surface and liquid-out passageway 38 between openings 40 and 42 formed through its surface. However, in an alternate embodiment of a valve core body of the present invention, the two passageways each may be provided between a respective exterior-facing opening and a respective container-facing opening in a core rotatable within valve housing 12 for aligning spout 24 with liquid-out aperture 20 and air-back aperture 22. Such an embodiment is shown in FIGS. 50–61.

Valve core 232, shown in FIGS. 50–53, preferably includes a substantially cylindrical and hollow valve core body 234 attached at one end to a handle 236 that preferably is substantially perpendicular to the longitudinal axis $A_3$ of core body 234. Preferably, a liquid-out passageway 238 (see FIGS. 55 and 59) is formed within core body 234, between an exterior-facing opening 240 and a container-facing opening 242 that are formed through the peripheral surface of core body 234. Preferably, container-facing opening 242 is substantially rectangular, having a height $H_3$ and a length $L_3$, as shown. A substantially separate air-back passageway 244 (see FIGS. 56 and 60) is preferably formed within core body 234, between an container-facing opening 246 and an exterior-facing opening 248 that are formed through the peripheral surface of core body 234. Preferably, container-facing opening 246 is substantially rectangular, having a height G and a length $d_1$, as shown, although many other shapes may be used without departing from the scope of the present invention.

Core body 234 is shown to extend substantially along longitudinal axis A3, from a preferably open end 233, across openings 240, 242, 246, and 248, to a preferably closed end 235 shared by handle 236, although end 233 may conceivably be closed in other embodiments. In a more particularly preferred embodiment, core 232 includes an actuation track 237. Track 237 is formed into the periphery of handle 236 closest to end 235, from a point $F_2$ to a point $E_2$, for limiting the rotation range of core 232 within a valve housing (as described above with reference to actuation track 37). Like valve core 32, valve core 232 may be formed from any suitable material such as high-density polyethylene, low-density polyethylene, polypropylene, or linear low-density polyethylene, and preferably is formed of the same material as body portion 14.

FIGS. 54–61 show how valve housing 12 of FIGS. 1–3C and valve core 232 of FIGS. 50–53 may be combined to form valve assembly 210 of the present invention. FIGS. 54–57 are similar to FIGS. 15–18, respectively, and FIGS. 58–61 are similar to FIGS. 31–34, respectively, but represent valve assembly 210 instead of valve assembly 10.

Figure 61:
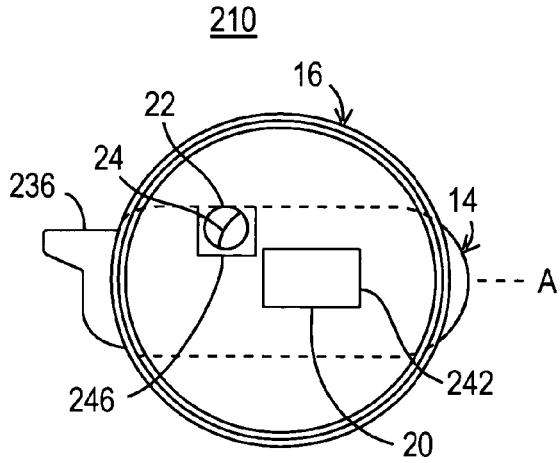
FIG. 61 is a rear elevational view of the valve assembly of FIGS. 54–60, taken from line 61—61 of FIG. 59, but with most of the fitment element omitted.
Figure 59:
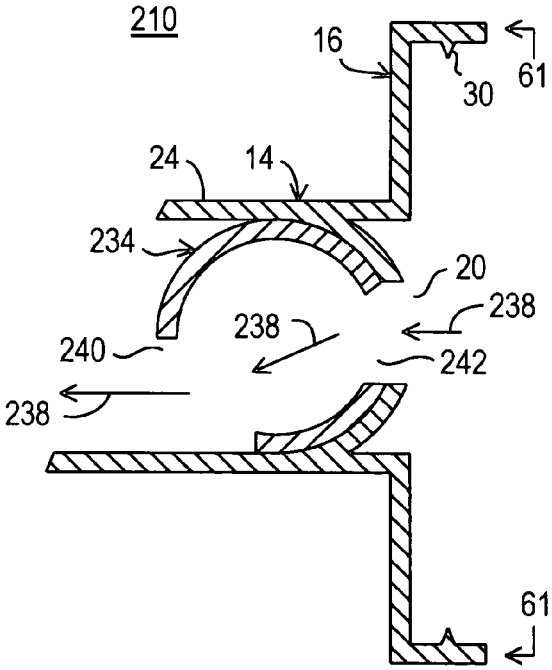
FIG. 59 is a vertical cross-sectional view of the valve assembly of FIGS. 54–58, taken from line 59—59 of FIG. 58.
Figure 60:
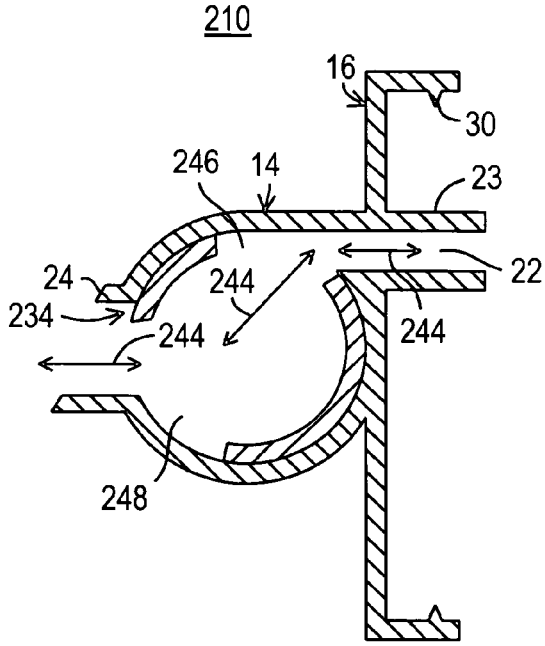
FIG. 60 is a vertical cross-sectional view of the valve assembly of FIGS. 54–59, taken from line 60—60 of FIG. 58.

Each of valve assemblies 10, 110, and 210, as shown in FIGS. 9–61, provides a core body within a housing body portion, preferably such that the core body is rotatable about a longitudinal axis shared by the core body and housing body portion preferably to regulate not only the flow of liquid from a container through a liquid-out passageway but also the flow of fluid between the container and the ambient atmosphere through an air-back passageway. However, in an alternate embodiment of a valve assembly of the present invention, a valve assembly may be provided in which the core body is translatable along a longitudinal axis shared by the core body and housing body portion, preferably to regulate not only the flow of liquid from a container through a liquid-out passageway but also the flow of fluid between the container and the ambient atmosphere through an air-back passageway. Such an embodiment is shown in FIGS. 62–75.

Valve housing 312, as shown in FIGS. 62–65 preferably includes a substantially hollow body portion 314 attached to a container fitment portion 316, which preferably extends from periphery or surface section 318 of body portion 314 substantially perpendicularly to longitudinal axis $A_4$ of body portion 314. Preferably, two apertures—a liquid-out aperture 320 and an air-back aperture 322—are formed through periphery 318 of body portion 314 to allow liquid and air to move between the hollow of body portion 314 and fitment portion 316, although any larger number of apertures may be provided.

In a preferred embodiment, liquid-out aperture 320 is substantially semi-circular, having a diameter $D_2$, and air-back aperture 322 is substantially rectangular, having a height $d_2$ and a length $D_3$, which, for example, may be substantially equal to $D_2$. In addition, a distance $h_1$ substantially separates the top of aperture 320 from the top of aperture 322, as shown, to provide a pressure difference between the container end of air-back aperture 322 and the container end of liquid-back aperture 320, for reasons explained above with respect to valve assembly 10. Extension tube 323 (not shown) preferably is provided to lower the pressure at the container end of air-back aperture 322 even more as compared to that at the container end of liquid-out aperture 320, for reasons also explained above with respect to valve housing 12 and as shown in FIG. 3C. Opposite fitment portion 316, a spout portion 324 preferably extends from body portion 314 for dispensing liquid from body portion 314 to a user and for supplying external air to body portion 314. Preferably, spout 324 provides a substantially "U-shaped" opening, having a diameter D4 and a side-length $h_2$, which, for example, may be substantially equal to $h_1$.

Body portion 314 is shown extending along longitudinal axis $A_4$, from preferably closed end 326, past spout portion 324 and apertures 320 and 322, to preferably closed end 328. In a more particularly preferred embodiment, an actuation track 321 is formed through periphery 318 of body portion 314 from a point $F_3$ substantially adjacent apertures 320 and 322 to a point $E_3$ substantially near end 326, and a pin 319 extends in substantially the same direction as spout 324 from a portion of surface 327 of fitment portion 316 that is separated from periphery 318 as a pivot for an actuator of a valve core (described below). Like valve housing 12, housing 312 may be formed from any suitable material such as high-density polyethylene, low-density polyethylene, polypropylene, linear low-density polyethylene, or other polymer.

Fitment portion 316, similar to fitment portion 16, preferably includes screw threads 330 to allow attachment of housing 312 to a threaded collar around an orifice in a side-wall of a liquid container (not shown). It will be appreciated that housing 312 may be attached to a container in other ways, such as with a snap-fitted collar, or by gluing or ultrasonic welding, etc. It should be noted that this attachment may be made at any angle relative to the bottom of the container (i.e., relative to the liquid level inside the container), as explained above with respect to valve assembly 10.

Figure 62:
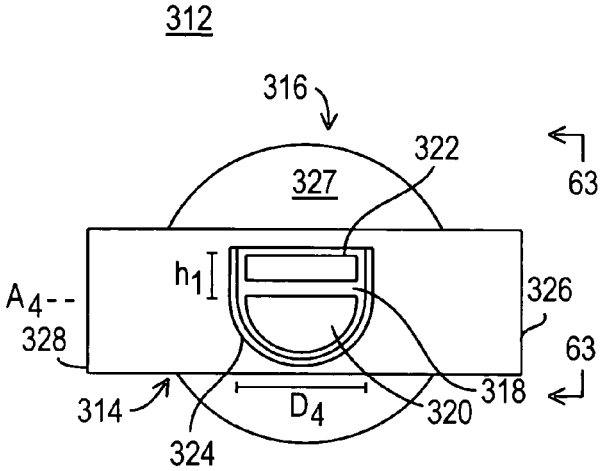
FIG. 62 is a front elevational view of a second embodiment of a valve housing according to the present invention.
Figure 63:
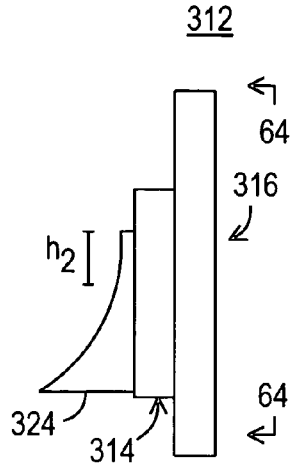
FIG. 63 is a side elevational view of the valve housing of FIG. 62, taken from line 63—63 of FIG. 62.
Figure 64:
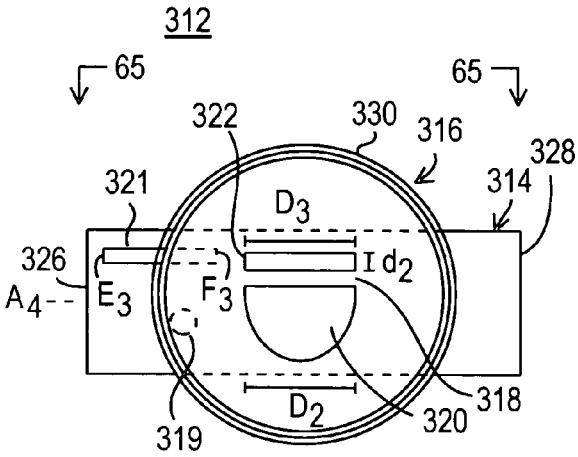
FIG. 64 is a rear elevational view of the valve housing of FIGS. 62 and 63, taken from line 64—64 of FIG. 63, but with most of the fitment element omitted.
Figure 65:
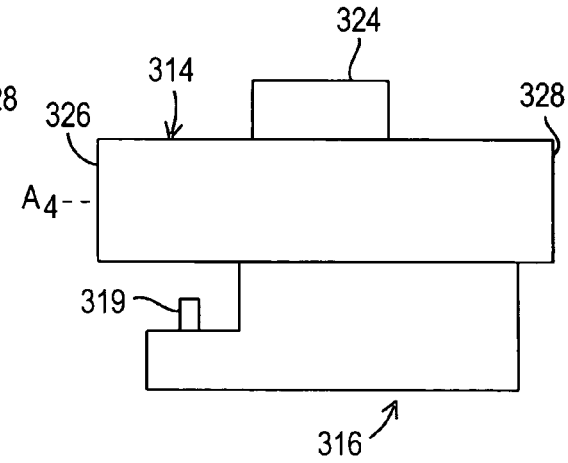
FIG. 65 is a top elevational view of the valve housing of FIGS. 62–64, taken from line 65—65 of FIG. 64.
Figure 66:
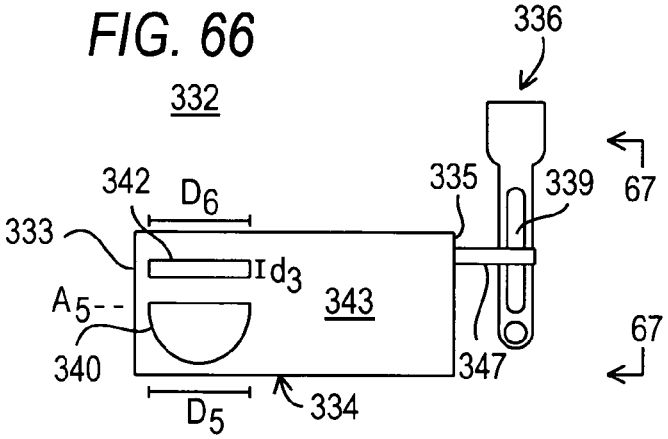
FIG. 66 is a front elevational view of a fourth embodiment of a valve core according to the present invention.
Figure 67:
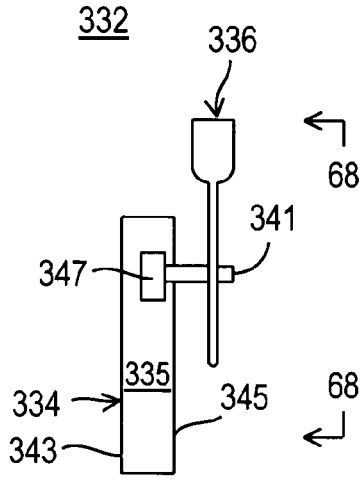
FIG. 67 is an end view of the valve core of FIG. 66, taken from line 67—67 of FIG. 66.
Figure 68:
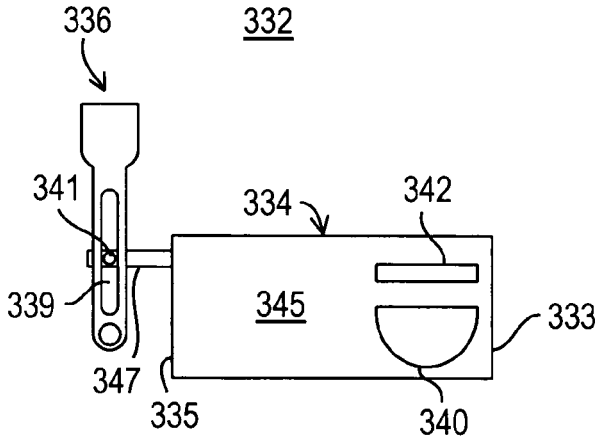
FIG. 68 is a rear elevational view of the valve core of FIGS. 66 and 67, taken from line 68—68 of FIG. 67.

As seen in FIGS. 66–68, valve core 332 preferably includes a substantially long and substantially solid valve core body 334 having a dispensing side 343 and a source side 345, that extends along a longitudinal axis $A_5$ (which when assembled with valve housing 312 preferably is substantially coincident with axis $A_4$ of FIG. 62) from end 333 to end 335. In a more particularly preferred embodiment, an extension 347 extends from end 335 along axis $A_5$ that includes pin 341. However, in an other embodiment, pin 341 could extend from source side 345 near end 335, although the core body might have to be made longer. Either way, a handle or actuator 336 preferably rotates at pin 319 of fitment portion 316 about an axis $A_6$ that is substantially perpendicular to $A_5$ (see FIG. 74). Slot 339 is preferably formed through handle 336 for converting rotation of handle 336 into translational motion of core body 334 by interaction with pin 341. In an other embodiment (not shown), pin 319, and the hole in handle 336, through which pin 319 extends, could be replaced by a molded living hinge, where handle 336 is attached to valve housing 312.

Preferably, a liquid-out passageway 338 (see FIGS. 70, 71, and 76) is formed by a liquid-out gap 340 through core body 334, between dispensing side 343 and source side 345. In a preferred embodiment, liquid-out gap 340 is substantially semi-circular, having a diameter $D_5$, which, for example, may be substantially equal to $D_2$. Preferably, an air-back passageway 344 (see FIGS. 70, 71, and 76) is formed by an air-back gap 342 through core body 334, between dispensing side 343 and source side 345. In a preferred embodiment, air-back gap 342 is substantially rectangular, having a height $d_3$ and a length $D_6$, which, for example may be substantially equal to $d_2$ and $D_3$, respectively. Like valve core 32, valve core 332 may be formed from any suitable material such as high-density polyethylene, low-density polyethylene, polypropylene, linear low-density polyethylene, or other polymer, and preferably is of the same material as body portion 314.

FIGS. 69–76 show how valve housing 312 of FIGS. 62–65 and valve core 332 of FIGS. 66–68 may be combined to form valve assembly 310 of the present invention. Preferably, core body 334 creates a seal within the hollow of body portion 314 and is translatable along longitudinal axis $A_4$, which is shared by core body 334 and body portion 314. Pin 341 preferably extends through track 321 of body portion 314 and through slot 339 of handle 336. Through rotation of handle 336 about axis $A_6$, and the interaction of pin 341 with slot 339 and the ends of track 321, core body 334 translates within body portion 314 along axis A4 such that the geometry of housing 312 and core 332 (described above) preferably regulates not only the flow of liquid from a container, through liquid-out aperture 320, liquid-out passageway 338, and spout 324 to the user, but also the supply of external air through spout 324, air-back passageway 344, and air-back aperture 322 to the interior of the container above the liquid level therein. As in the case of valve assemblies 10, 110, and 210, once a partial vacuum is created inside the container, valve assembly 310 also preferably provides a seal between the housing and the core that is sufficient to substantially maintain the partial vacuum inside the container after the valve is closed.

Figure 69:
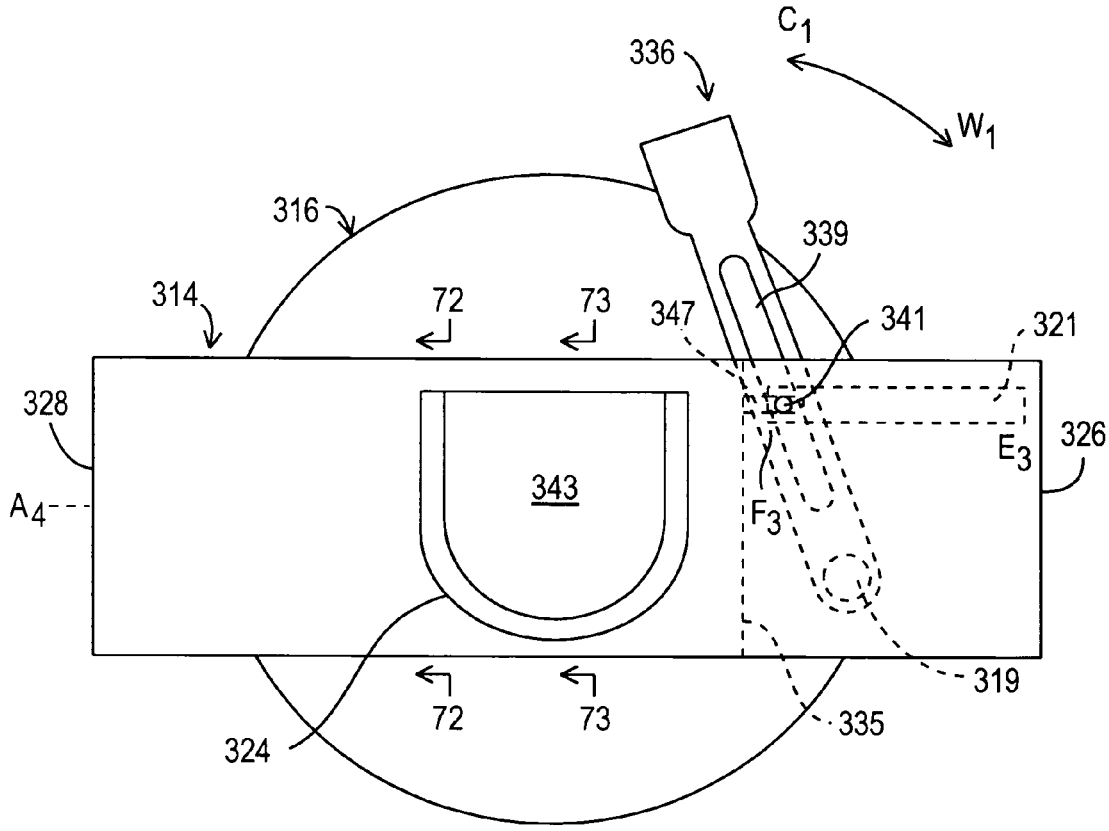
FIGS. 69–71 are front elevational views of an assembled valve of the present invention, incorporating the housing of FIGS. 62–65 and the core of FIGS. 66–68, in different stages of actuation, but with a portion of the fitment element omitted.
Figure 70:
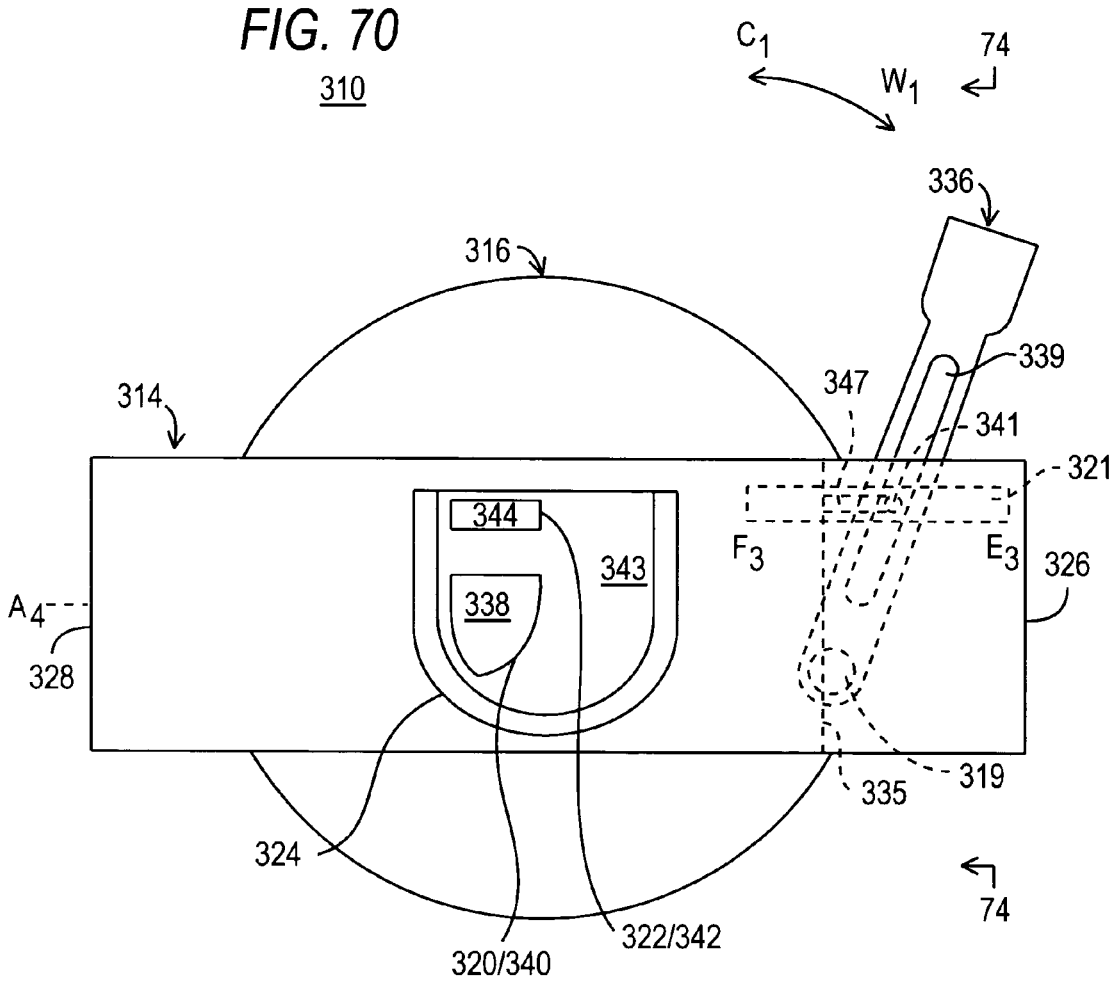
Figure 71:
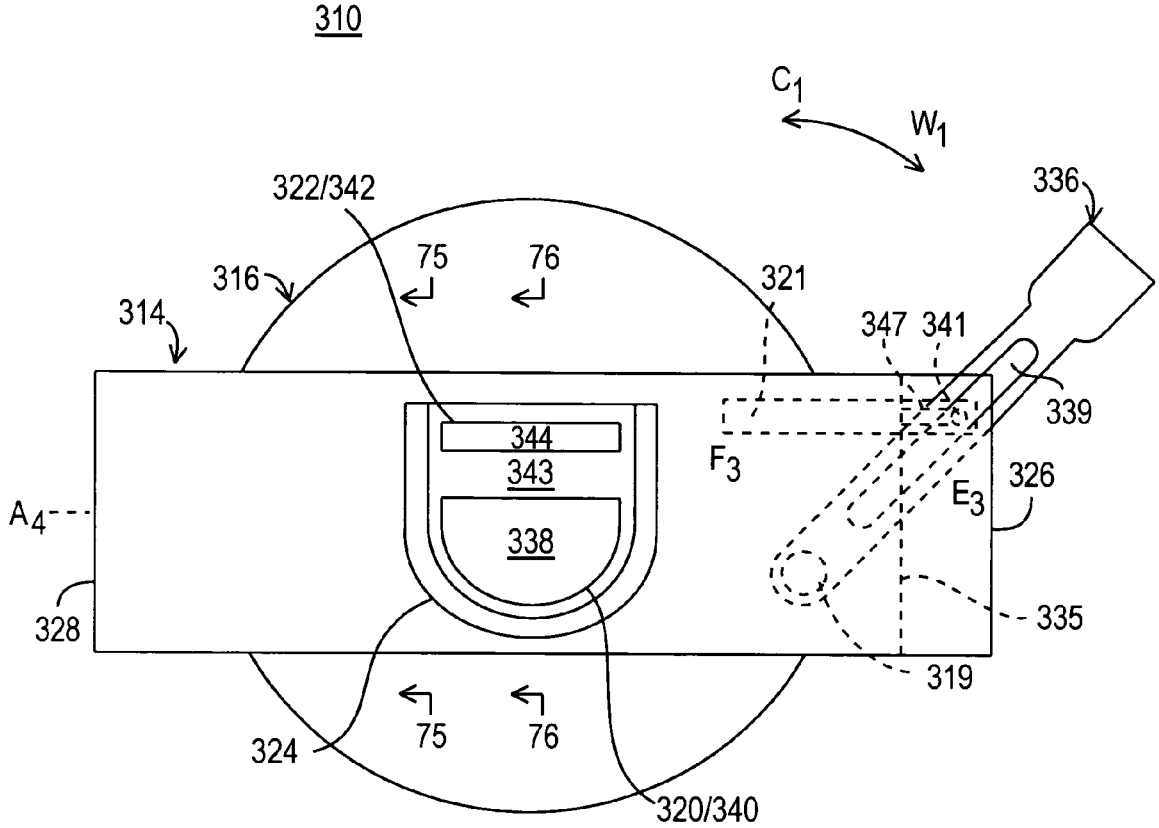

FIGS. 69–71 are front elevational views of valve assembly 310 having core 332 actuated to two different positions, although there may be an infinite amount of positions therebetween, as indicated by the location of pin 341 between ends $E_3$ and $F_3$ of track 321. FIG. 69 shows valve assembly 310 in a "closed" position. In this position, pin 341 of core body 334 is located essentially at end $F_3$, and handle 336 is rotated as far as possible in direction $C_1$.

Figure 73:
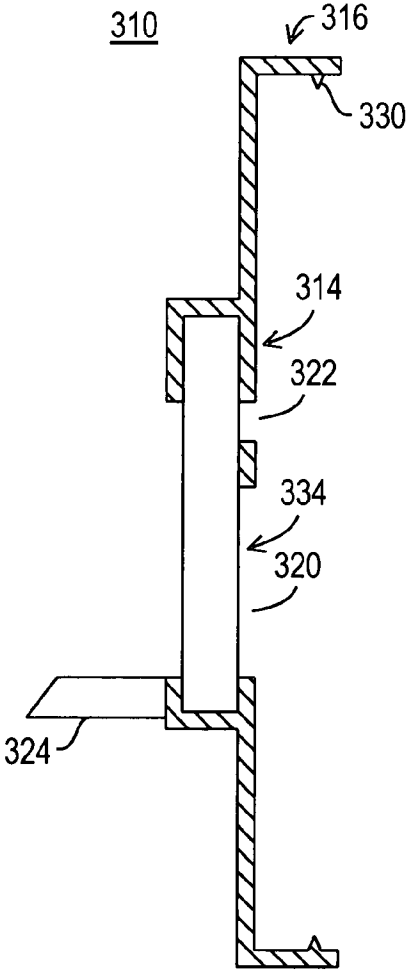
FIG. 73 is a vertical cross-sectional view of the valve assembly of FIGS. 69–72, taken from line 73—73 of FIG. 69.
Figure 72:
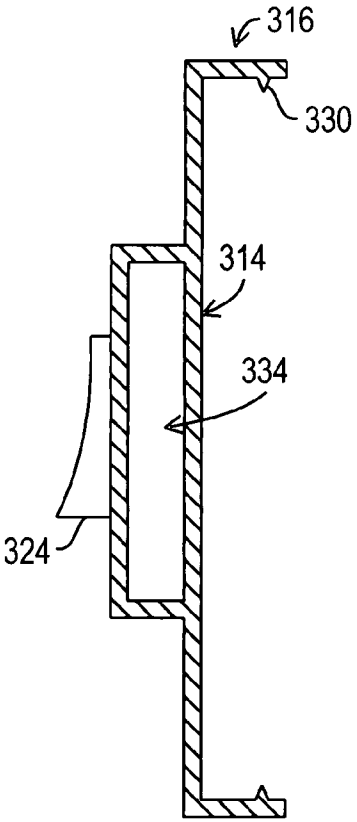
FIG. 72 is a vertical cross-sectional view of the valve assembly of FIGS. 69–71, taken from line 72—72 of FIG. 69.

Preferably, in this closed position shown in FIG. 69 and also in FIGS. 72 and 73, no portion of liquid-out gap 340 is aligned with any portion of liquid-out aperture 320 and spout 324. Therefore, the solid of core body 334 covers substantially all of liquid-out aperture 320 and spout 324, thereby preventing the flow of liquid through liquid-out passageway 338 within the hollow of body portion 314 between liquid-out aperture 320 and spout 324. Furthermore, no portion of air-back gap 342 is aligned with any portion of air-back aperture 322 and spout 324. Therefore, the solid of core body 334 covers substantially all of air-back aperture 322 and spout 324, thereby preventing the flow of fluid through air-back passageway 344 within the hollow of body portion 314 between air-back aperture 322 and spout 324.

FIG. 70 shows valve assembly 310 in a "halfway ON" position. In this position, pin 341 of core body 334 is essentially halfway between end $F_3$ and end $E_3$.

Figure 74:
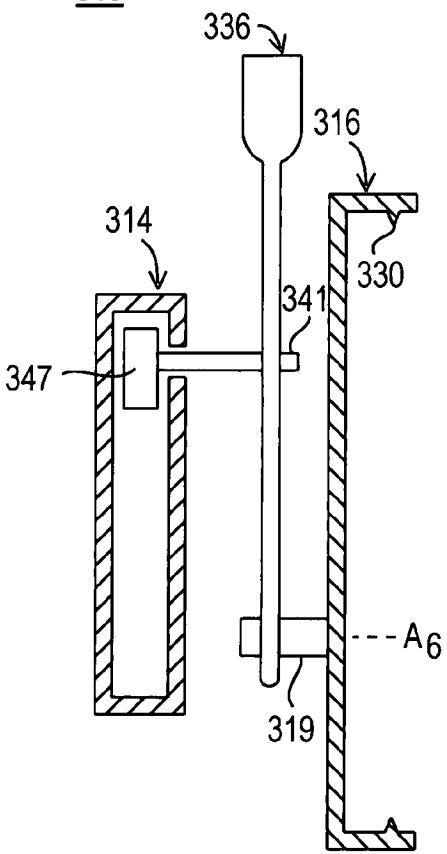
FIG. 74 is a vertical cross-sectional view of the valve assembly of FIGS. 69–73, taken from line 74—74 of FIG. 70.

Preferably, in this halfway ON position shown in FIG. 70 and also in FIG. 74, core body 334 has been translated to align substantially half of liquid-out gap 340 with substantially half of liquid-out aperture 320 and spout 324, thereby allowing liquid to flow between liquid-out aperture 320 and spout 324 through liquid-out passageway 338. Furthermore, in this halfway ON position, core body 334 preferably has been translated to expose substantially half of air-back gap 342 with substantially half of air-back aperture 322 and spout 324, thereby allowing fluid to flow between air-back aperture 322 and spout 324 through air-back passageway 344.

FIG. 71 shows valve assembly 310 in a "completely ON" position. In this position, pin 341 of core body 334 is located essentially at end $E_3$, and handle 336 is rotated as far as possible in direction W1.

Figure 76:
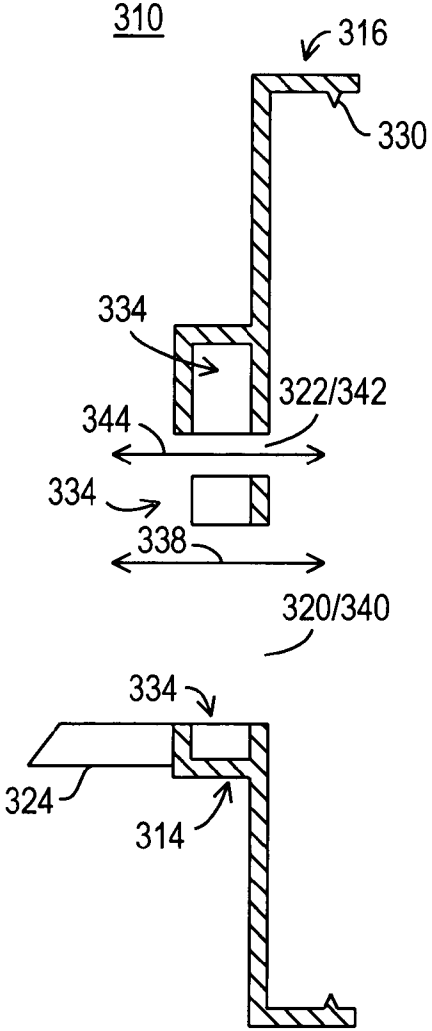
FIG. 76 is a vertical cross-sectional view of the valve assembly of FIGS. 69–75, taken from line 76—76 of FIG. 71.
Figure 75:
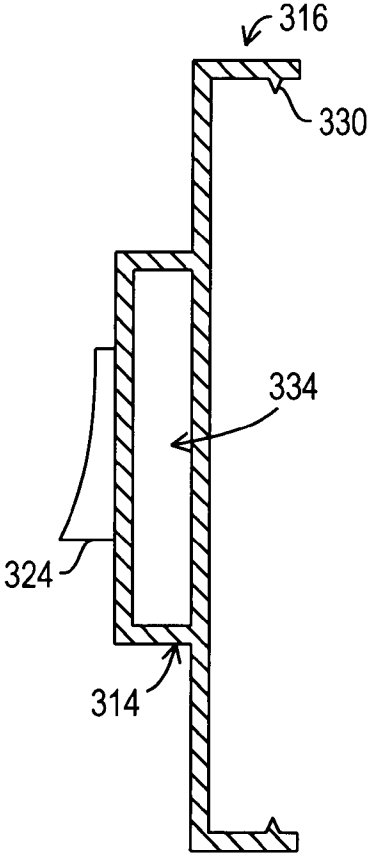
FIG. 75 is a vertical cross-sectional view of the valve assembly of FIGS. 69–74, taken from line 75—75 of FIG. 71.

Preferably, in this completely ON position shown in FIG. 71 and also in FIGS. 75 and 76, core body 334 has been translated to align substantially all of liquid-out gap 340 with substantially all of liquid-out aperture 320 and spout 324, thereby allowing liquid to flow between liquid-out aperture 320 and spout 324 through liquid-out passageway 338. Furthermore, in this completely ON position, core body 334 preferably has been translated to expose substantially all of air-back gap 342 with substantially all of air-back aperture 322 and spout 324, thereby allowing fluid to flow between air-back aperture 322 and spout 324 through air-back passageway 344.

The core body in the embodiment of FIGS. 69–76 moves translationally by actuation of handle 336. Other mechanisms for moving the core translationally can be provided. For example, the core body and the housing body portion may be threaded so that rotation of the core body, in a manner similar to the embodiments of FIGS. 15, 42, and 54, also causes translation of the core body.

Figure 77:
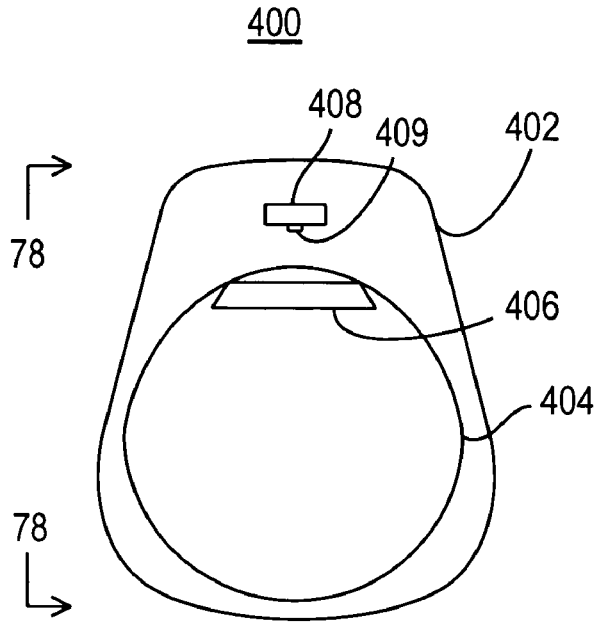
FIG. 77 is a rear elevational view of a dust cover according to the present invention.
Figure 78:
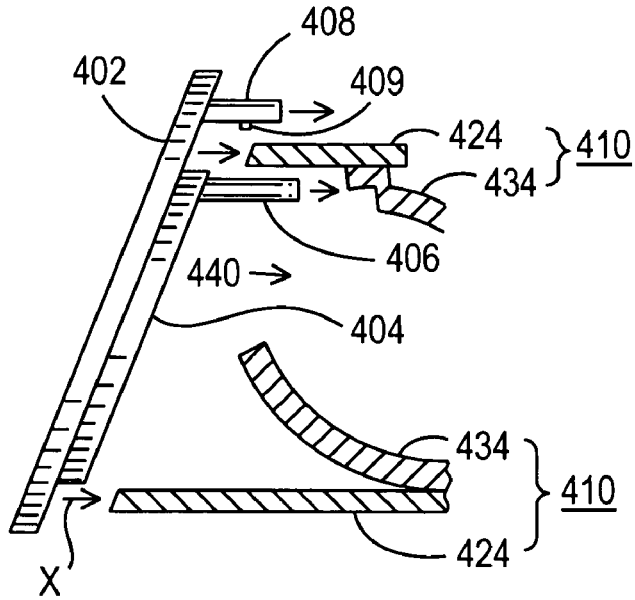
FIG. 78 is a partially sectional side view of the dust cover of FIG. 77, taken from line 78—78 of FIG. 77, cooperating with the valve assembly of FIG. 9.

A dust cover 400 for shielding the spout of a valve assembly of the present invention when it is not dispensing liquid is shown in FIGS. 77 and 78. Cover 400 includes face portion 402, plug portion 404, stop portion 406, and tamper portion 408 with breakaway nub 409. Preferably, face portion 402 is large enough to cover substantially all of spout 424 of valve assembly 410, which may be similar to assembly 10 and which is partially shown in FIG. 78. Extending away from face 402 is plug portion 404 that is preferably about the same shape as spout 424, but of a size that can fit within spout 424 when cover 400 is inserted into assembly 410 along direction X. In a preferred embodiment, the relative sizes of the spout and the plug are such that, when inserted into valve assembly 410, it is difficult for cover 400 to be removed therefrom unintentionally. Stop portion 406 extends from plug 404 to a particular length, such that when cover 400 is inserted into valve assembly 410, stop 406 contacts a portion of valve core body 434 therein to substantially bar actuation of the core to a position which can permit dispensation of liquid through spout 424. For example, stop 406 may extend into exterior-facing opening 440. Finally, nub 409 of tamper portion 408 may be frangibly affixed to a part of valve assembly 410 before valve assembly 410 is initially used.

In order to dispense liquid through a valve assembly provided with a dust cover 400 of the present invention, the cover must be removed in a direction substantially opposite to direction $X_1$ (as explained above). When initially removed, nub 409 preferably breaks away from valve assembly 410. If a user finds that initial removal is too easy, in that nub 409 need not be broken off its attachment to valve assembly 410, the user may take that as a sign of tampering. Once initially removed, the user may put dust cover 400 back into its original position in order to keep dirt and debris out of the spout between uses, and preferably also to prevent actuation of the valve to a position which can permit dispensing of liquid through the spout.

Thus it is seen that a valve assembly for dispensing and controlling a smooth and continuous outflow of liquid, even from an unvented or rigid container, has been provided. It should be noted that the shapes and sizes of the liquid-out apertures, liquid-out gaps, air-back apertures, air-back gaps, spouts, exterior-facing openings, container-facing openings, and channels described above are only exemplary. One skilled in the art will appreciate that the present invention can be practiced by other than the described embodiments, which are presented for purposes of illustration and not of limitation, and the present invention is limited only by the claims which follow.

What is claimed is:

1. A container comprising:

an orifice in a side-wall of said container;

a valve attachment to which a valve assembly is attached in communication with said orifice; and said valve assembly for providing to a user continuous liquid flow from said container, said valve assembly comprising:

valve housing, wherein said valve housing comprises:

housing body portion having an air-back aperture and a liquid-out aperture in a first side facing said orifice, a spout in a second side facing away from said orifice, and a substantially hollow interior between said first side and said second side along a longitudinal axis; and a housing attachment extending from said air-back aperture and said liquid-out aperture on said first side that attaches said housing body portion to said valve attachment; and a valve core; wherein:

said valve core comprises a core body having a liquid-out passageway and an air-back passageway;

said core body moves within said hollow interior to register said liquid-out passageway with said liquid-out out aperture and said spout to control liquid flow through said liquid-out passageway; and said core body moves within said hollow interior to register said air-back passageway with said air-back aperture and said spout to control fluid flow through said air-back passageway, wherein said core body has a peripheral surface, and wherein at least one of said liquid-out passageway and said air-back passageway is formed about said core body into said peripheral surface of said core body.

2. The container of claim 1 wherein:

said valve core further comprises an actuator; and said actuator is coupled to said core body and extends out from said hollow interior.

3. The container of claim 2 wherein said core body is movable to positions of differing degrees of registration of said liquid-out passageway with said liquid-out aperture and said spout and of said air-back passageway between said air-back aperture and said spout by movement of said actuator.

4. The container of claim 3 wherein said core body is rotatable about said longitudinal axis to said positions of differing degrees of registration by movement of said actuator.

5. The container of claim 4 wherein said core body is rotatable about said longitudinal axis to said positions of differing degrees of registration by rotation of said actuator.

6. The container of claim 1 wherein, when said housing attachment is attached to said valve attachment and said container is in an orientation in which it is used for dispensing liquid, the container end of said air-back aperture facing said orifice is at least partially above the container end of said liquid-out aperture facing said orifice.

7. The container of claim 1 further comprising an extension tube extending from said air-back aperture on said first side.

8. The container of claim 1 wherein:
said core body has a peripheral surface; and
said liquid-out passageway is formed within said core body between a first opening formed through a first portion of said peripheral surface of said core body and a second opening formed through a second portion of said peripheral surface of said core body.

9. The container of claim 8 wherein said first opening is substantially the same shape as said liquid-out aperture.

10. The container of claim 1 wherein:
said core body has a peripheral surface; and
said air-back passageway is formed about said core body in a channel formed into a first portion of said peripheral surface of said core body.

11. The container of claim 10 wherein:
said channel extends circumferentially about said core body between a first edge and a second edge;
said first edge has a first width; and
said second edge has a second width.

12. The container of claim 11 wherein said second width is greater than said first width.

13. The container of claim 11 wherein:
said air-back aperture has a third width; and
said third width is substantially equal to said first width.

14. The container of claim 1 wherein:
said core body is movable in a first direction from a first position, wherein:
said liquid-out passageway is registered such that no liquid flows through said liquid-out passageway; and
said air-back passageway is registered such that no fluid flows through said air-back passageway; and
to a second position, wherein:
said liquid-out passageway is registered such that liquid flows from said container substantially only through said liquid-out passageway; and
said air-back passageway is registered such that air flows into said container substantially only through said air-back passageway.

15. The container of claim 14 wherein:
said core body further comprises an actuation track; and
said housing body further comprises an actuation stop, wherein, when in said first position:
said actuation stop interacts with said actuation track to prevent said core body from being movable in a second direction substantially opposite to said first direction.

16. The container of claim 1 wherein said container is rigid.

17. The container of claim 1 wherein said container is unvented.

18. The container of claim 17 wherein said container is rigid.

19. A valve assembly for providing to a user continuous liquid flow from a container, said container having an orifice in a side-wall and a valve attachment to which said valve assembly is attached in communication with said orifice, said valve assembly comprising:
a valve housing, wherein said valve housing comprises:
a housing body portion having an air-back aperture and a liquid-out aperture in a first side facing said orifice, a spout in a second side facing away from said orifice, and a substantially hollow interior between said first side and said second side along a longitudinal axis; and
a housing attachment extending from said air-back aperture and said liquid-out aperture on said first side that attaches said housing body portion to said valve attachment; and
a valve core; wherein:
said valve core comprises a core body having a liquid-out passageway and an air-back passageway;
said core body moves within said hollow interior to register said liquid-out passageway with said liquid-out aperture and said spout to control liquid flow through said liquid-out passageway; and
said core body moves within said hollow interior to register said air-back passageway with said air-back aperture and said spout to control fluid flow through said air-back passageway, wherein said core body has a peripheral surface, and wherein at least one of said liquid-out passageway and said air-back passageway is formed about said core body into said peripheral surface of said core body.

20. The valve assembly of claim 19 wherein:
said valve core further comprises an actuator; and
said actuator is coupled to said core body and extends out from said hollow interior.

21. The valve assembly of claim 20 wherein said core body is movable to positions of differing degrees of registration of said liquid-out passageway with said liquid-out aperture and said spout and of said air-back passageway between said air-back aperture and said spout by movement of said actuator.

22. The valve assembly of claim 21 wherein said core body is rotatable about said longitudinal axis to said positions of differing degrees of registration by movement of said actuator.

23. The valve assembly of claim 22 wherein said core body is rotatable about said longitudinal axis to said positions of differing degrees of registration by rotation of said actuator.

24. The valve assembly of claim 19 wherein, when said housing attachment is attached to said valve attachment and said container is in an orientation in which it is used for dispensing liquid, the container end of said air-back aperture facing said orifice is at least partially above the container end of said liquid-out aperture facing said orifice.

25. The valve assembly of claim 19 further comprising an extension tube extending from said air-back aperture on said first side.

26. The valve assembly of claim 19 wherein:
said core body has a peripheral surface; and
said liquid-out passageway is formed within said core body between a first opening formed through a first portion of said peripheral surface of said core body and a second opening formed through a second portion of said peripheral surface of said core body.

27. The valve assembly of claim 26 wherein said first opening is substantially the same shape as said liquid-out aperture.

28. The valve assembly of claim 19 wherein:

said core body has a peripheral surface; and said air-back passageway is formed about said core body in a channel formed into a first portion of said peripheral surface of said core body.

29. The valve assembly of claim 28 wherein:

said channel extends circumferentially about said core body between a first edge and a second edge;

said first edge has a first width; and said second edge has a second width.

30. The valve assembly of claim 29 wherein said second width is greater than said first width.

31. The valve assembly of claim 29 wherein:

said air-back aperture has a third width; and said third width is substantially equal to said first width.

32. The valve assembly of claim 19 wherein:

said core body is movable in a first direction from a first position, wherein:

said liquid-out passageway is registered such that no liquid flows through said liquid-out passageway; and said air-back passageway is registered such that no fluid flows through said air-back passageway; and to a second position, wherein:

said liquid-out passageway is registered such that liquid flows from said container substantially only through said liquid-out passageway; and said air-back passageway is registered such that air flows into said container substantially only through said air-back passageway.

33. The valve assembly of claim 32 wherein:

said core body further comprises an actuation track; and said housing body further comprises an actuation stop, wherein:

when in said first position, said actuation stop interacts with said actuation track to prevent said core body from being movable in a second direction substantially opposite to said first direction; and when in said second position, said actuation stop interacts with said actuation track to prevent said core body from being movable in said first direction.

34. The valve assembly of claim 19 wherein said container is unvented.

35. The valve assembly of claim 34 wherein said container is rigid.

36. A valve assembly comprising:

a valve housing having an air-back aperture and a liquid-out aperture in a source side, a spout in a dispensing side, and a substantially hollow interior between said source side and said dispensing side and along a longitudinal axis; and a valve core having a core body for movement within said hollow interior for providing a liquid-out passageway between said liquid-out aperture and said spout, and for providing an air-back passageway between said air-back aperture and said spout, wherein said core body has a peripheral surface, and wherein at least one of said liquid-out passageway and said air-back passageway is formed about said core body into said peripheral surface of said core body.

37. The valve assembly of claim 36 wherein:

said core body has a peripheral surface; and said liquid-out passageway is formed within said core body between a first opening formed through a first portion of said peripheral surface of said core body and a second opening formed through a second portion of said peripheral surface of said core body.

38. The valve assembly of claim 36 wherein:

said core body has a peripheral surface; and said air-back passageway is formed about said core body in a channel formed into a first portion of said peripheral surface of said core body.

39. The valve assembly of claim 36 wherein:

said air-back aperture and liquid-out aperture are formed substantially adjacent to one another through a first portion of said source side of said valve housing.

40. The valve assembly of claim 39 further comprising a housing attachment extending from said first portion of said source side away from said hollow interior.

41. The valve assembly of claim 36 wherein:

said valve core further comprises an actuator; and said actuator is coupled to said core body and extends out from said hollow interior.

42. The valve assembly of claim 41 wherein said core body is movable within said hollow interior by movement of said actuator to vary the degree of registration of said liquid-out passageway with said liquid-out aperture and said spout.

43. The valve assembly of claim 41 wherein said core body is movable within said hollow interior by movement of said actuator to vary the degree of registration of said air-back passageway with said air-back aperture and said spout.

44. The valve assembly of claim 41 wherein said core body is movable within said hollow interior by movement of said actuator to vary the degree of registration of said liquid-out passageway with said liquid-out aperture and said spout, and to vary the degree of registration of said air-back passageway with said air-back aperture and said spout.

45. The valve assembly of claim 44 wherein said degree of registration of said liquid-out passageway varies substantially proportionally to said degree of registration of said air-back passageway.

46. The valve assembly of claim 41 wherein said core body is movable within said hollow interior by movement of said actuator for varying the degree of registration of said liquid-out passageway with said liquid-out aperture and said spout to control the flow of liquid through said liquid-out passageway, and for varying the degree of registration of said air-back passageway with said air-back aperture and said spout to control the flow of fluid through said air-back passageway.

47. The valve assembly of claim 46 wherein said degree of registration of said liquid-out passageway varies substantially proportionally to said degree of registration of said air-back passageway.

48. The valve assembly of claim 46 wherein said core body is rotatable about said longitudinal axis by movement of said actuator to vary said degree of registration of said liquid-out passageway and said air-back passageway.

49. The valve assembly of claim 48 wherein said core body is rotatable about said longitudinal axis by rotation of said actuator to vary said degree of registration of said liquid-out passageway and said air-back passageway.

50. A container comprising:

an orifice in a side-wall of said container; and a valve attachment to which said housing attachment of claim 36 in communication with said orifice, wherein:

when said housing attachment is attached to said valve attachment and said container is in an orientation in which it is used for dispensing liquid, the container end of said air-back aperture facing said orifice is at least partially above the container end of said liquid-out aperture facing said orifice.

51. The valve assembly of claim 50 wherein said container is rigid.

52. The container of claim 50 wherein said container is unvented.

53. The container of claim 52 wherein said container is rigid.

54. A valve assembly for providing to a user continuous liquid flow from a container, said container having an orifice in a side-wall and orifice attachment means for attachment of said valve assembly about said orifice, said valve assembly comprising:

a valve housing, wherein said valve housing comprises:

a housing body portion having an air-back aperture and a liquid-out aperture in a first side facing said orifice, a spout in a second side facing away from said orifice, and a substantially hollow interior between said first side and said second side; and housing attachment means extending from said first side about said air-back aperture and said liquid-out aperture for attaching said housing body portion to said orifice attachment means; and a valve core wherein:

said valve core comprises a core body wherein;

said core body moves within said hollow interior to register a liquid-out passageway with said liquid-out aperture and said spout to control the flow of liquid through said liquid-out passageway; and said core body moves within said hollow interior to register an air-back passageway with said air-back aperture and said spout to control the flow of fluid through said air-back passageway, wherein said core body has a peripheral surface, and wherein at least one of said liquid-out passageway and said air-back passageway is formed about said core body into said peripheral surface of said core body.

55. The valve assembly of claim 54 wherein:

said valve core further comprises an actuator; and said actuator is coupled to said core body and extends out from said hollow interior.

56. The valve assembly of claim 55 wherein said core body is movable within said hollow interior by movement of said actuator from a first position wherein at least one of the conditions from the group consisting of the following is true to prevent liquid flow through said liquid-out passageway: 1) no portion of a first end of said liquid-out passageway is aligned with any portion of said liquid-out aperture, 2) no portion of said first end of said liquid-out passageway is aligned with any portion of said spout, 3) no portion of the second end of said liquid-out passageway is aligned with any portion of said liquid-out aperture, and 4) no portion of said second end of said liquid-out passageway is aligned with any portion of said spout, to a second position wherein at least a first portion of said first end of said liquid-out passageway is aligned with at least a first portion of said liquid-out aperture and at least a first portion of the second end of said liquid-out passageway is aligned with at least a first portion of said spout to allow liquid flow through said liquid-out passageway.

57. The valve assembly of claim 56 wherein, when in said second position, said first end of said liquid-out passageway is completely aligned with at least said first portion of said liquid-out aperture.

58. The valve assembly of claim 56 wherein, when in said second position, said second end of said liquid-out passageway is completely aligned with at least a first portion of said spout.

59. The valve assembly of claim 56 wherein, when in said second position, at least said first portion of said first end of said liquid-out passageway is completely aligned with said liquid-out aperture.

60. The valve assembly of claim 56 wherein, when in said second position, at least said first portion of said second end of said liquid-out passageway is completely aligned with said spout.

61. The valve assembly of claim 56 wherein, when in said second position, said first end of said liquid-out passageway is completely aligned with said liquid-out aperture and said second end of said liquid-out passageway is completely aligned with said spout.

62. The valve assembly of claim 56 wherein said liquid-out passageway is provided within said core body from a first liquid-out opening at said first end of said liquid-out passageway to a second liquid-out opening at said second end of said liquid-out passageway.

63. The valve assembly of claim 56 wherein, when in said first position, at least one of the conditions from the group consisting of the following is true to prevent fluid flow through said air-back passageway: 1) no portion of a first end of said air-back passageway is aligned with any portion of said air-back aperture, 2) no portion of said first end of said air-back passageway is aligned with any portion of said spout, 3) no portion of the second end of said air-back passageway is aligned with any portion of said air-back aperture, and 4) no portion of said second end of said air-back passageway is aligned with any portion of said spout.

64. The valve assembly of claim 56 wherein, when in said second position, at least a first portion of a first end of said air-back passageway is aligned with at least a first portion of said air-back aperture and at least a first portion of the second end of said air-back passageway is aligned with at least a first portion of said spout to allow fluid flow through said air-back passageway.

65. The valve assembly of claim 64 wherein, when in said second position, said first end of said air-back passageway is completely aligned with at least said first portion of said air-back aperture.

66. The valve assembly of claim 64 wherein, when in said second position, said second end of said air-back passageway is completely aligned with at least a first portion of said spout.

67. The valve assembly of claim 64 wherein, when in said second position, at least said first portion of said first end of said air-back passageway is completely aligned with said air-back aperture.

68. The valve assembly of claim 64 wherein, when in said second position, at least said first portion of said second end of said air-back passageway is completely aligned with said spout.

69. The valve assembly of claim 64 wherein, when in said second position, said first end of said air-back passageway is completely aligned with said air-back aperture and said second end of said air-back passageway is completely aligned with said spout.

70. The valve assembly of claim 56 wherein, when in said first position, at least one of the conditions from the group consisting of the following is true to prevent fluid flow through said air-back passageway: 1) no portion of said air-back passageway is aligned with any portion of said air-back aperture and 2) no portion of said air-back passageway is aligned with any portion of said spout.

71. The valve assembly of claim 56 wherein, when in said second position, said air-back passageway is aligned with at least a first portion of said air-back aperture and at least a first portion of said spout to allow fluid flow through said air-back passageway.

72. The valve assembly of claim 71 wherein, when in said second position, said air-back passageway is completely aligned with said air-back aperture.

73. The valve assembly of claim 70 wherein said air-back passageway is provided about the peripheral surface of said core body in an air channel extending from a first end portion of said air-back passageway to a second end portion of said air-back passageway.

74. The valve assembly of claim 55 wherein said core body is movable within said hollow interior by movement of said actuator from a first position wherein at least one of the conditions from the group consisting of the following is true to prevent liquid flow through said liquid-out passageway: 1) no portion of said liquid-out passageway is aligned with any portion of said liquid-out aperture and 2) no portion of said liquid-out passageway is aligned with any portion of said spout, to a second position wherein said liquid-out passageway is aligned with at least a first portion of said liquid-out aperture and at least a first portion of said spout to allow liquid flow through said liquid-out passageway.

75. The valve assembly of claim 74 wherein, when in said second position, said liquid-out passageway is completely aligned with said liquid-out aperture.

76. The valve assembly of claim 74 wherein, when in said first position, at least one of the conditions from the group consisting of the following is true to prevent fluid flow through said air-back passageway: 1) no portion of a first end of said air-back passageway is aligned with any portion of said air-back aperture, 2) no portion of said first end of said air-back passageway is aligned with any portion of said spout, 3) no portion of the second end of said air-back passageway is aligned with any portion of said air-back aperture, and 4) no portion of said second end of said air-back passageway is aligned with any portion of said spout.

77. The valve assembly of claim 74 wherein, when in said second position, at least a first portion of a first end of said air-back passageway is aligned with at least a first portion of said air-back aperture and at least a first portion of the second end of said air-back passageway is aligned with at least a first portion of said spout to allow fluid flow through said air-back passageway.

78. The valve assembly of claim 77 wherein, when in said second position, said first end of said air-back passageway is completely aligned with at least said first portion of said air-back aperture.

79. The valve assembly of claim 77 wherein, when in said second position, said second end of said air-back passageway is completely aligned with at least a first portion of said spout.

80. The valve assembly of claim 77 wherein, when in said second position, at least said first portion of said first end of said air-back passageway is completely aligned with said air-back aperture.

81. The valve assembly of claim 77 wherein, when in said second position, at least said first portion of said second end of said air-back passageway is completely aligned with said spout.

82. The valve assembly of claim 77 wherein, when in said second position, said first end of said air-back passageway is completely aligned with said air-back aperture and said second end of said air-back passageway is completely aligned with said spout.

83. The valve assembly of claim 74 wherein, when in said first position, at least one of the conditions from the group consisting of the following is true to prevent fluid flow through said air-back passageway: 1) no portion of said air-back passageway is aligned with any portion of said air-back aperture and 2) no portion of said air-back passageway is aligned with any portion of said spout.

84. The valve assembly of claim 74 wherein, when in said second position, said air-back passageway is aligned with at least a first portion of said air-back aperture and at least a first portion of said spout to allow fluid flow through said air-back passageway.

85. The valve assembly of claim 84 wherein, when in said second position, said air-back passageway is completely aligned with said air-back aperture.

86. The valve assembly of claim 83 wherein said air-back passageway is provided about the peripheral surface of said core body in an air channel extending from a first end portion of said air-back passageway to a second end portion of said air-back passageway.

87. The valve assembly of claim 54 wherein said housing body portion has a longitudinal axis, and wherein said core body is rotatable within said hollow interior about said longitudinal axis.

88. The valve assembly of claim 87 wherein:

said valve core further comprises an actuator;

said actuator is coupled to said core body and extends out from said hollow interior; and said core body is rotatable within said hollow interior about said longitudinal axis by movement of said actuator.

89. The valve assembly of claim 88 wherein said core body is rotatable within said hollow interior about said longitudinal axis by rotation of said actuator.

90. The valve assembly of claim 54 wherein, when said housing attachment means attaches to said orifice attachment means, the container end of said air-back aperture is above the container end of said liquid-out aperture with respect to the bottom of said container.

91. The valve assembly of claim 54 wherein said container is rigid.

92. The container of claim 54 wherein said container is unvented.

93. The container of claim 92 wherein said container is rigid.

94. The valve assembly of claim 55 wherein said core body is movable within said hollow interior by movement of said actuator from a first position wherein fluid is prevented from flowing between said liquid-out aperture and said spout and from flowing between said air-back aperture and said spout, to a second position wherein at least a first portion of said liquid-out passageway is aligned with at least a first portion of said liquid-out aperture and at least a first portion of said spout to allow liquid flow through said liquid-out passageway and wherein at least a first portion of said air-back passageway is aligned with at least a first portion of said air-back aperture and at least a second portion of said spout to allow fluid flow through said liquid-out passageway.

* * * * *

UNITED STATES PATENT AND TRADEMARK OFFICE

CERTIFICATE OF CORRECTION

PATENT NO. : 7,219,819 B2
APPLICATION NO. : 10/692995
DATED : May 22, 2007
INVENTOR(S) : J. Wayne Halfacre et al.

It is certified that error appears in the above-identified patent and that said Letters Patent is hereby corrected as shown below:

Column 8, line 21, change "1s" to --1*s*--.

Column 8, line 29, change "1*s*[1]" to --$\mathbf{1}_{s1}$--.

Column 8, line 30, change "11" to --$\mathbf{1}_1$--.

Column 8, line 31, change "11" to --$\mathbf{1}_1$--.

Column 9, line 23, change "A1" to --$A_1$--.

Column 9, line 27, change "A1" to --$A_1$--.

Signed and Sealed this

Seventh Day of August, 2007

JON W. DUDAS
*Director of the United States Patent and Trademark Office*